US005836578A

United States Patent [19]

Hirano et al.

[11] Patent Number: 5,836,578

[45] Date of Patent: Nov. 17, 1998

[54] FINISHING APPARATUS PROVIDED WITH STAPLING FUNCTION

[75] Inventors: Ryo Hirano, Toyohashi; Yuji Taguchi, Itami; Shinji Wakamatsu, Toyokawa, all of Japan

[73] Assignee: Minolta Co., Ltd., Osaka, Japan

[21] Appl. No.: 821,444

[22] Filed: Mar. 21, 1997

[30] Foreign Application Priority Data

Mar. 22, 1996 [JP] Japan ..... 8-066143
Mar. 22, 1996 [JP] Japan ..... 8-066144

[51] Int. Cl.[6] ..... B65H 39/02

[52] U.S. Cl. ..... 270/58.11; 270/58.08

[58] Field of Search ..... 270/58.01, 58.08, 270/58.11, 58.12

[56] References Cited

U.S. PATENT DOCUMENTS 4,928,941 5/1990 Uto et al. ..... 270/58.14
5,104,106 4/1992 Shido et al. ..... 270/58.09
5,398,918 3/1995 Rizzolo et al. ..... 270/58.08 X

*Primary Examiner*—Hoang Nguyen
*Attorney, Agent, or Firm*—Burns, Doane, Swecker & Mathis, LLP

[57] ABSTRACT

A finisher is provided with a stapling unit which has a staple head and a staple anvil, the staple head and the staple anvil being separated and independently movable to a stapling point. When the staple head which contains staples is detected empty, the staple head goes to a staple cartridge exchange position. When a jam of staples is detected, the staple anvil goes to a retreating position. Also, a light emitting element is provided at the staple head and a light receiving element is provided at the staple anvil. First, the staple head is moved to/stopped at a specified stapling point, and then, the staple anvil is moved. The staple anvil is stopped when the light receiving element receives a light from the light emitting element.

24 Claims, 30 Drawing Sheets

FINISHING APPARATUS PROVIDED WITH STAPLING FUNCTION

BACKGROUND OF THE INVENTION

1. Field of the Invention

The present invention relates to a finishing apparatus and, more particularly, to a finishing apparatus of the type which sorts and/or staples sheets discharged from an image forming apparatus, such as electrophotographic copying machines or laser printers.

2. Description of Prior Art

Generally, various kinds of finishing apparatuses (usually called "finisher") have been known which sort image-formed sheets discharged from a copying machine into a desired number of sets or staple them. In conventional practice of stapling, it is common that a staple head and a staple anvil are fixed at home positions and a staple is applied to a corner portion of a sheet set. Recently, with automization and diversification of image-forming operations, finishing practice is diversified, and needs have been increasing for different modes of finishing, such as stapling a sheet set at plural points along a side portion (side stapling) and stapling a sheet set at a center portion (center stapling).

In order to carry out the side stapling and the center stapling, it is necessary to move a stapling unit in a width direction of a sheet set. In a point of adjusting positions of the staple head and the staple anvil, it is preferable that the staple head and the staple anvil which compose the stapling unit are connected in a body. However, when the center stapling is carried out, because of a connecting portion of the staple head and the staple anvil, a length of a sheet to be processed must be limited. Further, since a sheet set can be transported only after the connecting portion is retreated, an operating time of the center stapling becomes longer, thus, copying productivity is lowered.

Considering the above-mentioned inconvenience, if the connecting portion is removed by allowing the staple head and staple anvil to move independently, problems such as the limitation of sheet size and lowering of copying productivity can be solved. However, in case that the staple head and the staple anvil are moved independently, when staples which are contained in the staple head are used up (staple empty), or when staples are jammed, how to move the staple head and staple anvil comes into question.

Further, when the staple head and the staple anvil are moved independently, stopping positions of the both have to be adjusted precisely. That is, if the staple head and the staple anvil are mutually mispositioned, staples which arc discharged from the staple head do not hit the staple anvil correctly, thus, a failure in bending staples or/and a jam of staples are caused.

SUMMARY OF THE INVENTION

Accordingly, it is an object of the present invention to provide a finishing apparatus which is easy to handle without a limitation of sheet size and lowering of copying productivity with respect to stapling.

It is another object of the present invention to provide a finishing apparatus which does not cause lowering of productivity with respect to stapling and prevents a failure in bending staples or/and a staple jam by adjusting stopping positions of a staple head and a staple anvil correctly.

In order to attain the objects, a finishing apparatus according to the present invention comprises sheet stacking means which receives and stacks sheets discharged from an image forming apparatus, a staple head which drives staples to the stacked sheet set, a staple anvil which receives and bends staples driven from the staple head, first moving means which moves the staple head, and second moving means which moves the staple anvil. Further, the finishing apparatus comprises first detecting means which detects emptiness of the staple head and control means which, when emptiness of the staple head is detected by the detecting means, moves the staple head to a staple cartridge exchange position by driving the first moving means. Furthermore, the finishing apparatus comprises, second detecting means which detects a staple jam and control means which, when a staple jam is detected by the second detecting means, moves the staple anvil to a retreating position by driving the second moving means.

In the above-mentioned structure, the staple head and the staple anvil move independently to respective specified stapling points and staple a sheet set which is held on the sheet stacking means or a sheet set which is pulled partly or pulled wholly out of the sheet stacking means. In the present invention, since the connecting portion which connects the staple head and the staple anvil does not exist, the size of sheets to be stapled is not limited. Also, after stapling, since the sheet set can be transported from the stapling position without waiting the connecting portion to retreat, copying productivity is not lowered.

Moreover, in the present invention, since the staple head moves automatically to the staple cartridge exchange position when emptiness of the staple head is detected, the handling of the finisher becomes easy. Also, when a staple jam is detected, the staple anvil moves automatically to the retreating position. When staples are jammed, it is necessary to open the finisher and check inside. In this case, with the staple anvil moving to the retreating position automatically, the inside is checked easily without interference, thus, the checking operation becomes smooth.

Further, a finishing apparatus in accordance with the present invention comprises moving means which reciprocally moves the staple head and the staple anvil independently of each other, position detecting means which detects mutual positions of the staple head and the staple anvil and control means which moves either the staple head or the staple anvil to a specified stapling point, and after that, moves the other to a point detected by the detecting means.

In the above structure, stopping positions of the staple head and the staple anvil are adjusted correctly by the position detecting means which detects mutual positions of the both means. Thereby, a staple which is driven from the staple head hits the staple anvil accurately, problems such as a failure of bending staples or/and a staple jam can be solved.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE PREFERRED EMBODIMENTS

The description of preferred embodiments according to the present invention is given below, referring to the accompanying drawings.

(Copying system)

Figure 1:
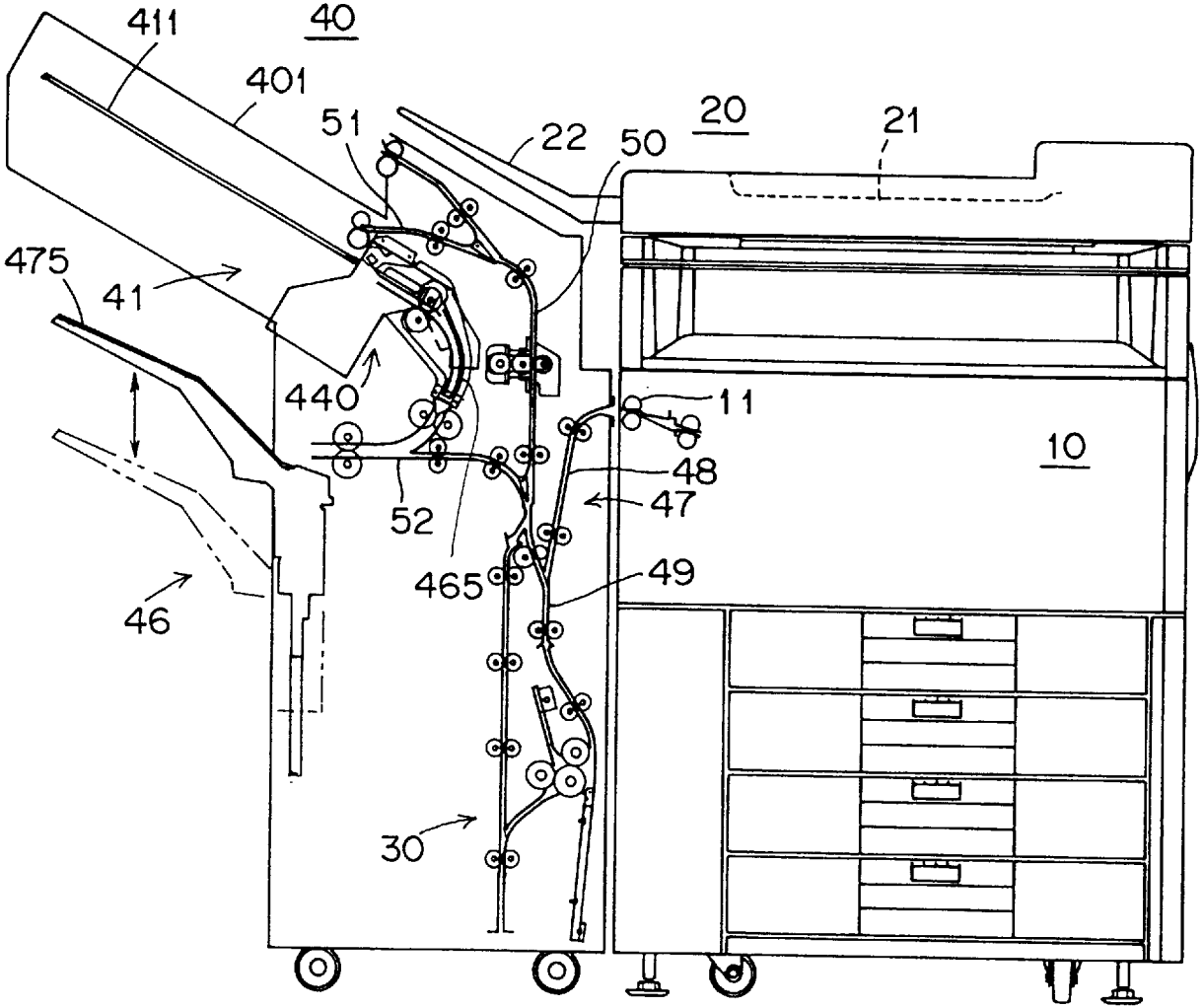
FIG. 1 is a schematic elevational view which shows a copying system including a finisher in accordance with the present invention.

FIG. 1 shows a copying system including a finishing apparatus (hereinafter referred to as "finisher") 40 which is an embodiment of the present invention, the finisher 40 being connected to a copying machine 10. The copying machine 10 is of the type in which an image is formed on a sheet in a well-known electrophotographic manner, such that sheets, as copying is effected thereon, are discharged from a sheet discharge station 11, one sheet at a time with image-formed surface turned up. An automatic document feeder 20 (hereinafter referred to as "ADF") is provided on the top of the copying machine 10. The ADF 20 feeds a set of documents set on a first tray 21, one document at a time, onto a platen glass (not shown) of the copying machine 10, each document being discharged/loaded onto a second tray 22 after an image has been read from the document. An image of each document set on the platen glass automatically by the ADF 20 or manually by an operator is read by an image reader (not shown) incorporated in the copying machine 10, and the read image is converted into digital data which in turn are stored in a memory of a controller. Copying operation is carried out by reading the image data with appropriate editing made as required. In particular, the controller permits various modes of copying operations including copying documents in different page orders, document image reversal processing in which copying of a document image turned 180°, copying two document images on one copy sheet, and duplex copying in which copying is effected on both sides of a sheet.

(Finisher)

As FIG. 1 shows, the finisher 40 comprises a non-sort tray 401 for stacking/containing sheets discharged from the copying machine 10, a stapling section 41 for stacking sheets and stapling stacked sheets, a storing section 46 for storing a stapled set of sheets, and a sheet transport section 47 for selectively transporting sheets discharged from the copying machine 10 to the non-sort tray 401, the stapling section 41, or the storing section 46.

(Sheet Transport Section)

Figure 2:
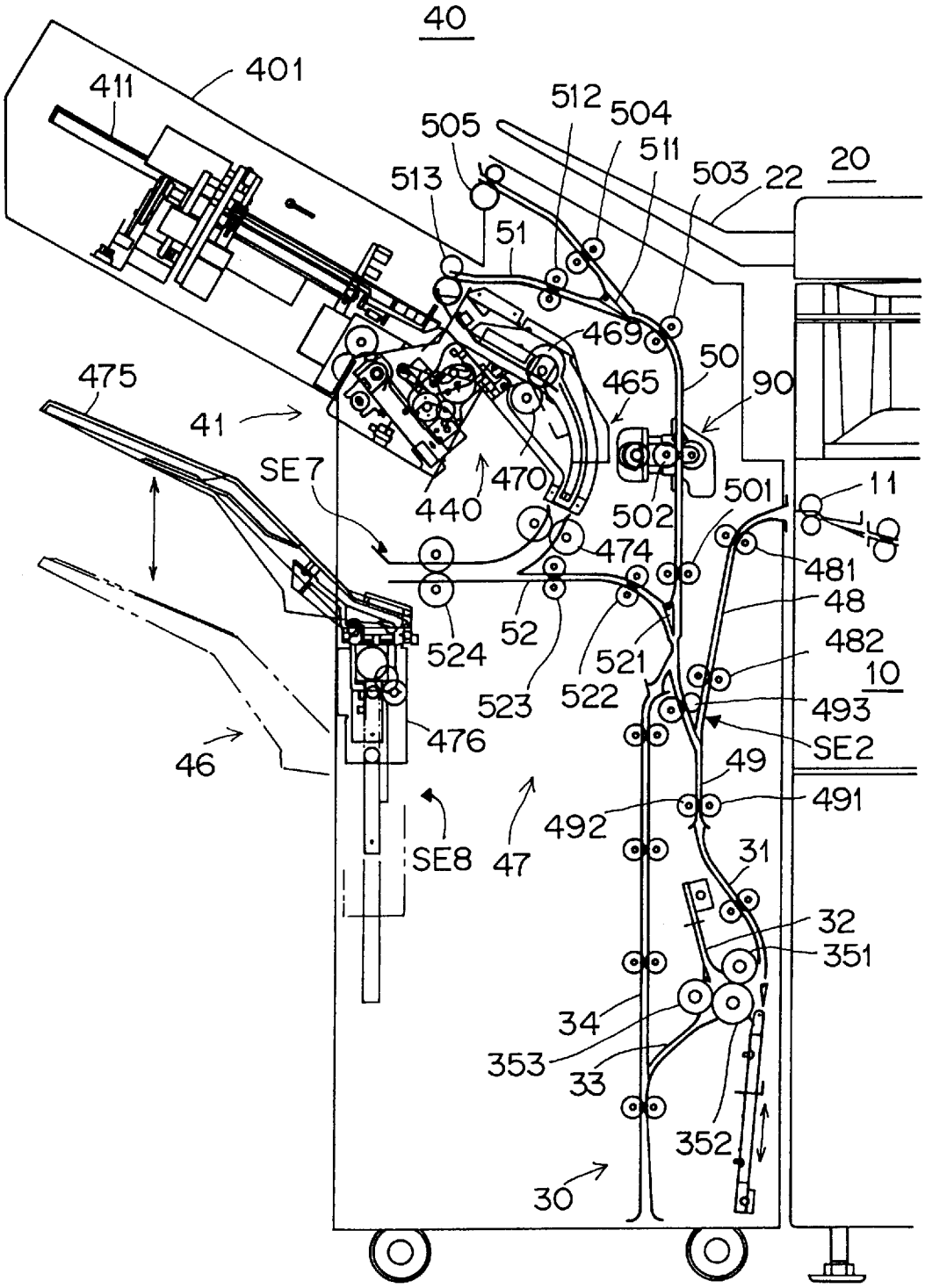
FIG. 2 is a schematic elevational view which shows the finisher.

The sheet transport section 47, as shown in FIG. 2, comprises a transport path 48 for receiving sheets from a sheet discharge station 11 of the copying machine 10 and transporting them downward, a switch-back transport path 49 for inverting sheets in leading-and-trailing/top-and-bottom relation, a transport path 50 for transporting sheets to the non-sort tray 401, a transport path 51 branched from the transport path 50 for transporting sheets to the stapling section 41, and a transport path 52 branched from the transport path 50 for transporting sheets to the storing section 46.

The transport path 48 comprises transport roller pairs 481 and 482. The switch-back transport path 49 comprises a transport roller 491 which is forward/reverse rotatable, a follower roller 492 driven to rotate in contact with the transport roller 491, a transport roller pair 493 for transporting switched-back sheets to either the transport path 50 or the transport path 52 and a sheet detecting sensor SE2.

A sheet transported along the transport path 48 is guided to the switch-back transport path 49. Upon lapse of a predetermined time after the trailing edge of the sheet being detected by the sensor SE2, that is, when the trailing edge of the sheet comes into the transport path 49, the transport roller 491 is switched reverse so that the sheet is transported upward.

The transport path 50 comprises transport roller pairs 501, 502, 503 and 504, a discharge roller pair 505. On the transport path 50 there is provided a punch mechanism 90 for punching a leading portion or a trailing portion of a sheet to make holes therein while the sheet is being transported. The punch mechanism 90 is well-known in the art and need not be described herein.

The transport path 51 comprises a diverter 511 for switching over the destination of sheet transport, a transport roller pair 512 and a discharge roller pair 513. The transport path 52 comprises a diverter 521 for switching over the destination of sheet transport, transport roller pairs 522, 523 and a discharge roller pair 524.

The diverters 511 and 521 are pivotable by solenoids (not shown). Each sheet transported through the switch-back transport path 49 is guided by the diverter 521 to one of the transport paths 50 and 52. Each sheet transported along the transport path 50 is guided on its way by the diverter 511 either for continued travel on the transport path 50 or for entry into the transport path 51. Sheets are transported from the discharge roller pair 505 to the non-sort tray 401, or from the discharge roller pair 513 to the stapling section 41, or from the discharge roller pair 524 to the storing section 46, whichever may be the case.

(Storing Section)

As FIG. 2 shows, the storing section 46 comprises a storing tray 475, a drive mechanism 476 for moving the tray 475 upward and downward, a sensor SE7 for detecting the amount of sheets stored, and a sensor SE8 for detecting a lower limit position of the storing tray 475. Onto the tray 475 are delivered sheets from the transport path 52, one at a time, in the case of bulk copying, or as will be described in detail later, sets of sheets stapled at the stapling section 41. Each time the sensor SE7 detects that a copy sheet is received/loaded on the storing tray 475, the tray 475 is lowered a predetermined quantity by the drive mechanism 476. When the descent of the tray 475 to the lower limit position is detected by the sensor SE8, the tray 475 is already fully occupied and accordingly subsequent copying operation is interrupted.

The arrangement of the drive mechanism 476 for lowering the tray 475 a predetermined quantity at a time for bulk sheet stacking is well-known in the art and need not be de scribed in detail herein.

(Folding Mechanism)

A folding mechanism 30 is provided immediately below the sheet transport section 47 and has a function to fold an image-formed sheet into two along a center line in the direction of sheet transport, a function to unfold the folded sheet and centrally form a fold line, and a function to Z-fold the sheet. The term "Z-fold" means a manner of folding such that the sheet is folded two times with the image-formed surface facing up. The folding mechanism 30 comprises three folding rollers 351, 352 and 353 and sheet transport paths 31, 32, 33 and 34. The folding mechanism 30 is not described in detail herein.

(Stapling Section)

Figure 3:
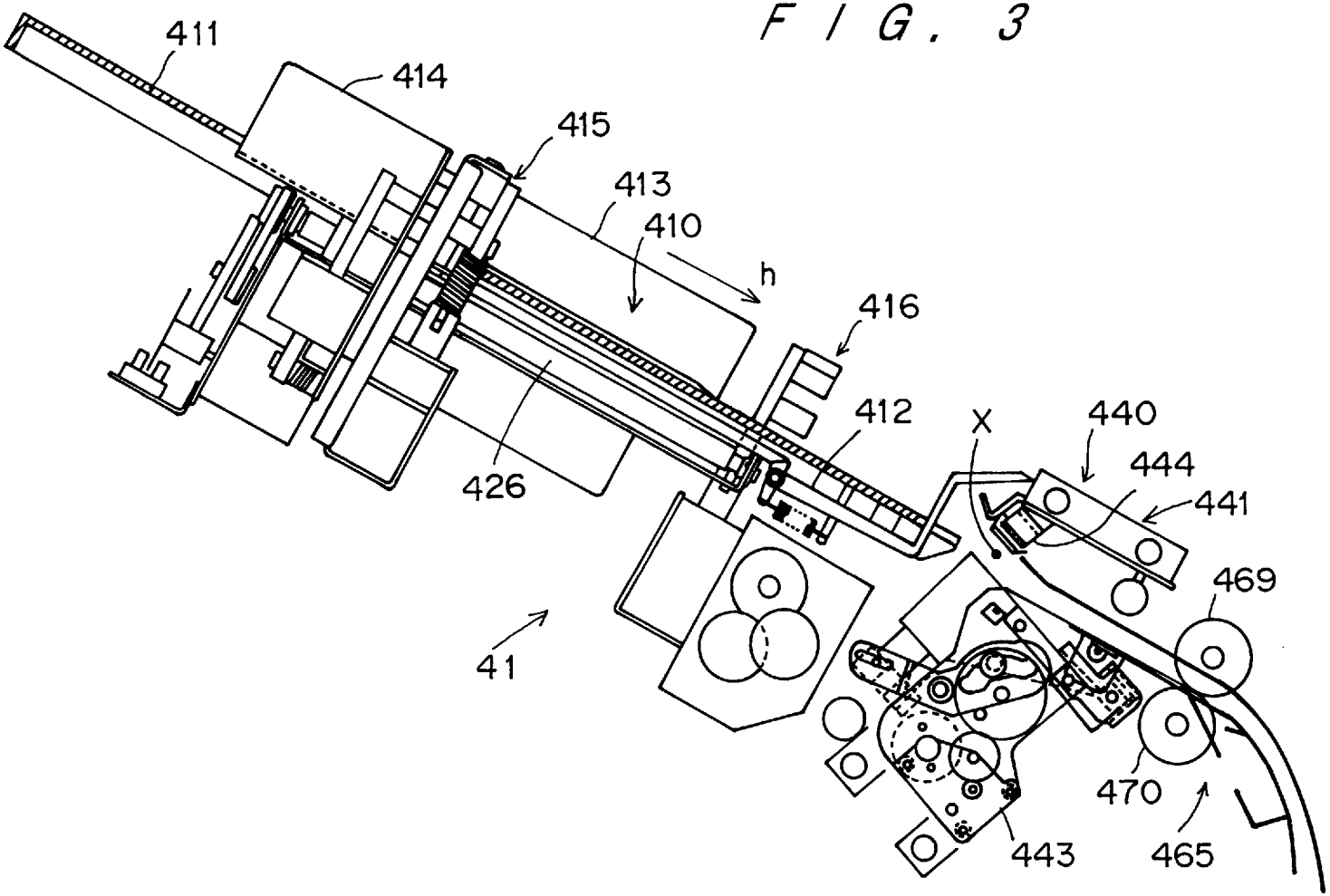
FIG. 3 is a front view which shows a stapling section.
Figure 4:
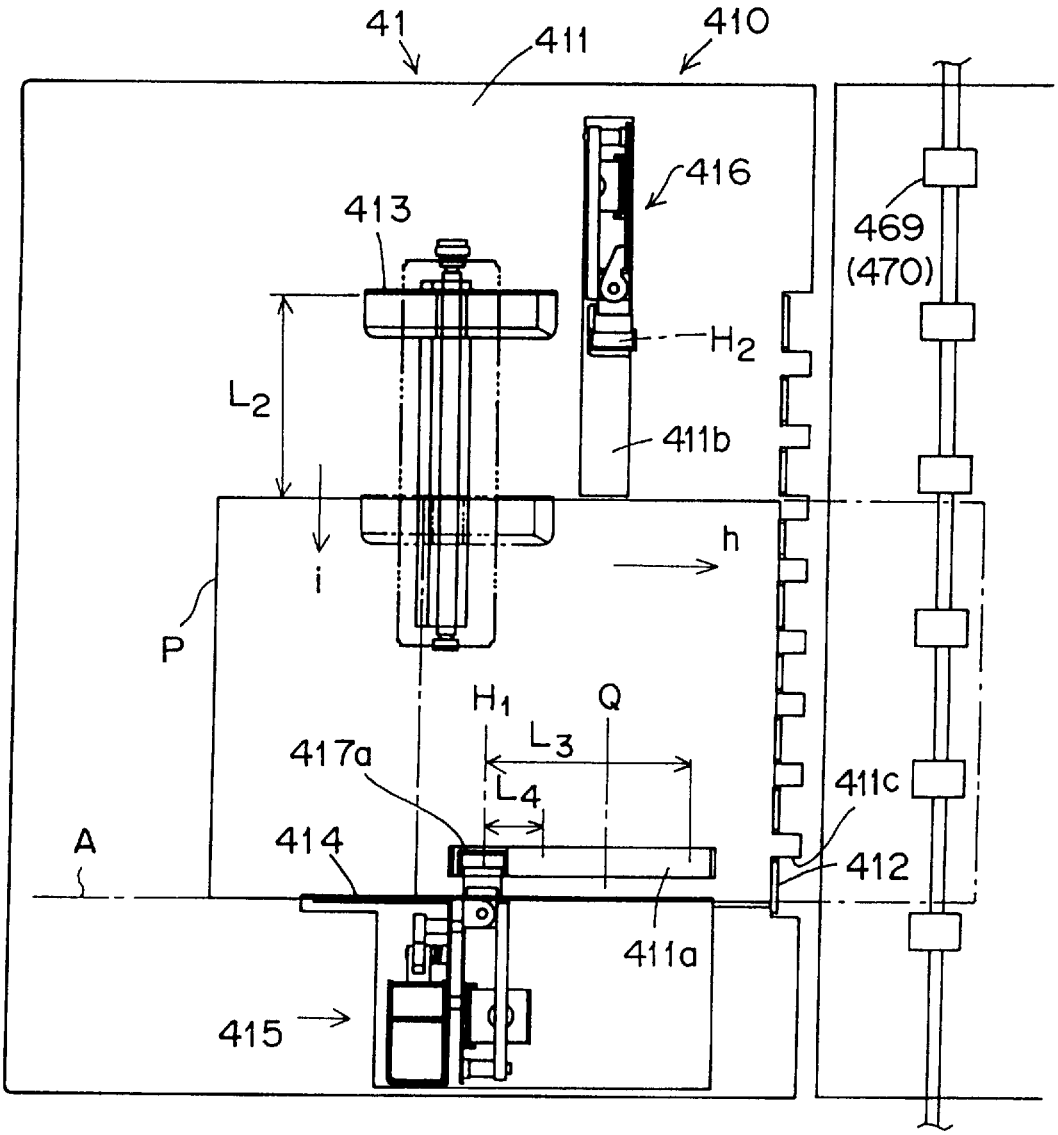
FIG. 4 is a plan view which shows a stacking tray.

Next, the stapling section 41 will be described. The stapling section 41 comprises a sheet stacking station 410 and a stapling station 440 as shown in FIGS. 3 and 4.

The sheet stacking station 410 comprises an inclined stacking tray 411, a lead stopper 412 mounted to a leading end portion of the stacking tray 411, a sheet side edge alignment plate 413, and first and second chucking devices 415, 416 which are capable of gripping/releasing sheets at sides thereof respectively.

The stacking tray 411 serves to temporarily stack and store sheets discharged from the transport path 51 with their image-formed surface facing down. The lead stopper 412 serves to stop leading edges (trailing edge when viewed in the direction of sheet discharge onto the tray 411) of sheets discharged onto the tray 411 and align the sheets in the direction of sheet transport to the stapling station 440 (indicated with an arrow h). The side alignment plate 413 is reciprocally movable in a direction (indicated with an arrow i) perpendicular to the direction of sheet transport and serves to align sheets laterally on the tray 411. The first chucking device 415 is disposed on the front side of the tray 411, and the second chucking device 416 is disposed on the rear side of the tray 411. These chucking devices 415, 416 are operative to grip sides of sheets alternately so as to prevent float-up of the sheets. The first chucking device 415 also has a function to grip a set of sheets for transport of the same to the stapling station 440.

(Side Alignment Plate)

Figure 5:
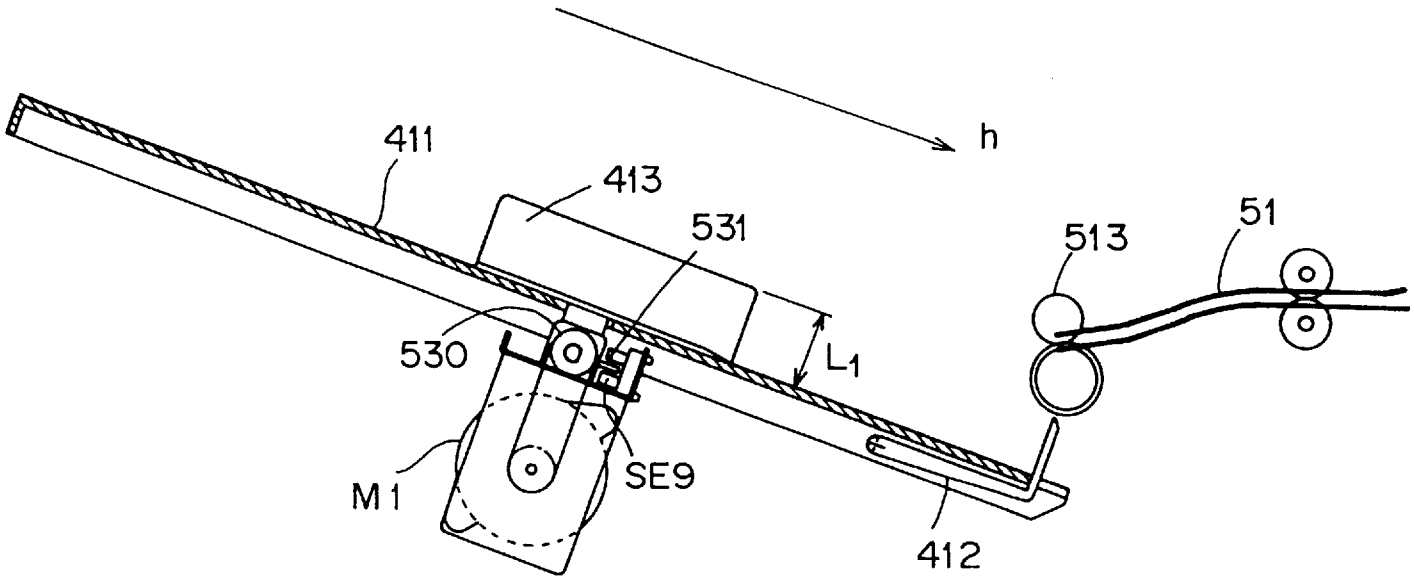
FIG. 5 is a sectional view which shows the stacking tray.

As shown in FIGS. 4 and 5, the side alignment plate 413 has a height $L_1$ that is higher than a maximum height of a sheet bulk that can be stored on the stacking tray 411, and is disposed at a position opposed to an alignment reference plate 414 mounted to the first chucking device 415. This alignment plate 413 is mounted on a spiral shaft 530 located on the rear side of the tray 411 for reciprocal movement on the shaft 530 in a direction indicated with the arrow i in accordance with the rotation of a spiral shaft 530, the spiral shaft 530 being forward/reverse driven by a stepping motor M1. The alignment plate 413, held on standby at a position indicated with a solid line in FIG. 4, is actuated through forward run of the stepping motor M1 to advance to an alignment position (indicated with a double-dashed chain line in FIG. 4) corresponding to the size of sheet P. In this case, the other side of the sheets P abuts the reference plate 414 for alignment. The presence of the alignment plate 413 at its home position is detected upon entry of a light shielding plate 531 fixed to the alignment plate 413 into the optical axis of a sensor SE9 disposed on the rear side of the tray 411. The distance $L_2$ of a run of the alignment plate 413 for its advance to the alignment position is determined by controlling the number of pulses for driving the stepping motor M1 in accordance with the size of the sheet P.

Sheets are transported on the sheet transport section 47 with their center taken as a reference line, and are individually discharged from the discharge roller pair 513 of the transport path 51 onto the stacking tray 411 (see double-dashed chain lines in FIG. 4). Upon lapse of a predetermined time period which is required for complete placement of the sheet on the tray 411, the stepping motor M1 is driven forward. When one sheet is aligned between the alignment plate 413 and the reference plate 414, the motor M1 is driven reverse and accordingly the alignment plate 413 retracts to the home position. Thus, each time a sheet is received onto the tray 411, the alignment plate 413 advances in the direction indicated with the arrow i to cause the sheet to abut the reference plate 414 for alignment on the tray 411 on a one-side reference basis.

(First Chucking Device)

Figure 6:
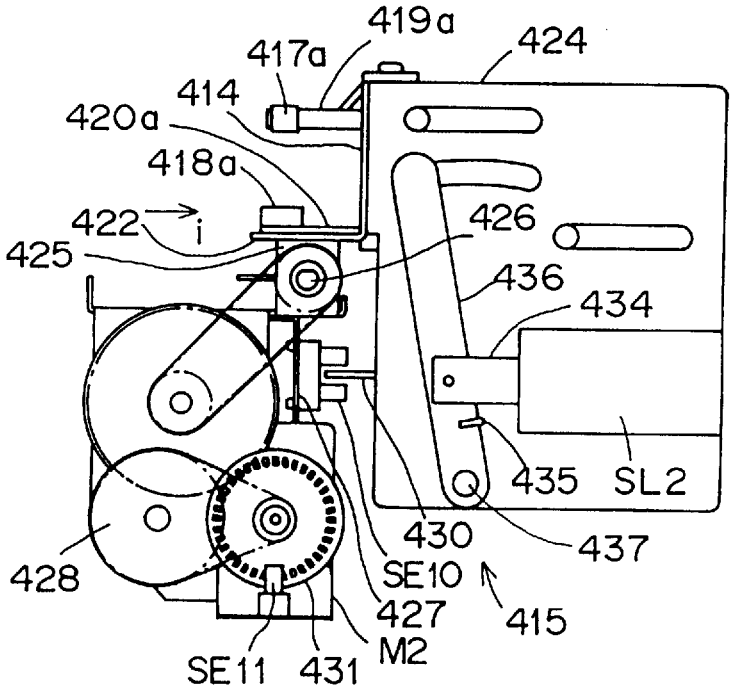
FIG. 6 is a front view which shows a first chucking device.
Figure 7:
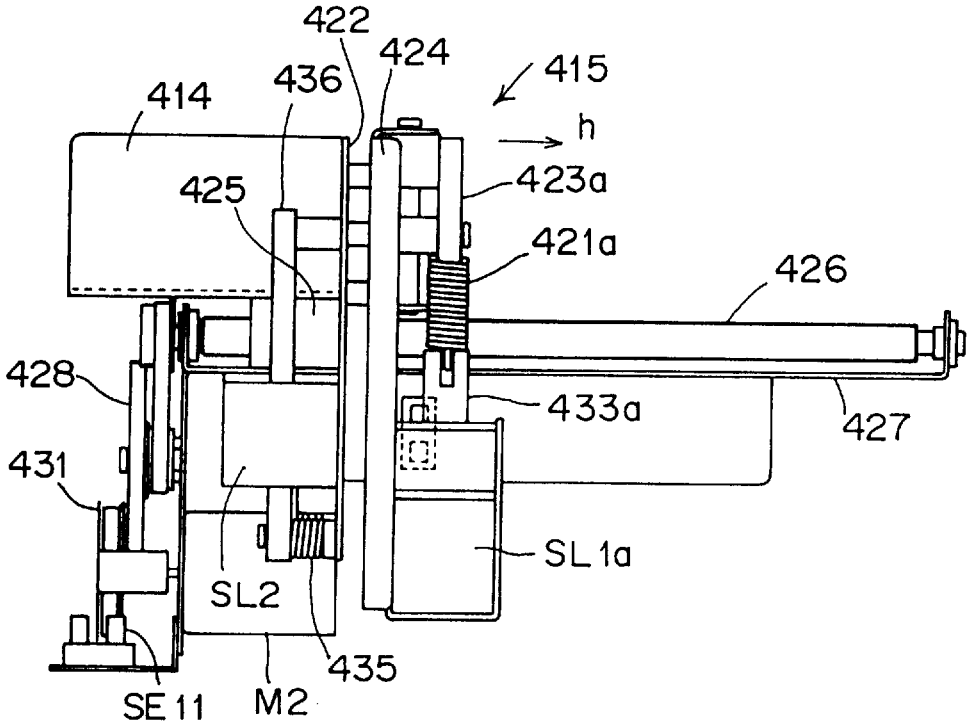
FIG. 7 is a side elevational view which shows the first chucking device.

As FIGS. 6 and 7 show, the first chucking device 415 comprises friction plates 417*a*, 418*a* made of a resilient material, support plates 419*a*, 420*a* for supporting the friction plates 417*a* and 418*a*, a solenoid SL1*a* for actuating the friction plate 417*a* to move upward and downward, and a support plate 422 for retaining these elements in position. The solenoid SL1*a* has a plunger 433*a* connected to the support plate 419*a* through a spring 421*a* and a lever 423*a* so that when the solenoid SL1*a* is turned on, the friction plate 417*a* is caused to move downward in conjunction with the support plate 419*a* to resiliently hold a side of sheets on the stacking tray 411 in cooperation with the friction plate 418*a*.

The friction plates 417*a*, 418*a* are set at a position shifted back in the direction indicated with the arrow i, rather than the chucking position shown in FIG. 6, that is, at a position offset from a side of a sheet aligned on the stacking tray 411 shown in FIG. 4. In order to cause the friction plates 417*a*, 418*a* and support plates 419*a*, 420*a* to shift to the chucking position in a direction opposite from the direction indicated with the arrow i, there is mounted a solenoid SL2 on a bracket 424. A plunger 434 of the solenoid SL2 is connected to a link 436 which is pivotable about a pin 437, the link 436 being connected at its ends to the support plates 419*a*, 420*a*. The link 436 is biased by a spring 435 wound on the pin 437 in the clockwise direction in FIG. 6. When the solenoid SL2 is turned off, the plunger 434 is in its retreating position and the friction plates 417*a* and 418*a*, together with the support plates 419*a* and 420*a*, are retreated outward of sheet P. Such retreating is intended to prevent the friction plate 417*a* and the support plate 419*a* from interfering with a sheet when the sheet P is received onto the tray 411. When the solenoid SL2 is turned on, the plunger 434 moves forward, and the link 436 rotates counterclockwise, so that the friction plates 417*a* and 418*a*, together with the support plates 419*a* and 420*a*, are caused to shift in a direction opposite from the direction indicated with the arrow i so as to be set in the chucking position.

Further, the first chucking device 415 is reciprocally movable in the direction indicated with the arrow h to transport a sheet set to the stapling station 440, with the sheet set grasped at one side by the first chucking device 415. For this movement, a nut member 425 fixed to a bracket 424 is threadingly fitted to a spiral shaft 426. The spiral shaft 426 is rotatably mounted to a frame 427 and is adapted to be forward/reverse driven by a motor M2 through a drive transmission 428 which comprises gears and belts. That is, through forward run of the motor M2, the spiral shaft 426 rotates forward to cause the first chucking device 415 to advance in a direction indicated with an arrow h, and through reverse run of the motor M2 the first chucking device 415 is caused to retreat. The presence of the first chucking device 415 in its home position $H_1$ is detected upon entry of a light shield plate 430 fixed to the bracket 424 into the optical axis of a sensor SE10 disposed on the frame 427.

On the output shaft of the motor M2 there is fixed a disc 431 having a plurality of small holes formed regularly along a circumferential edge portion thereof such that on the basis of the rotation of the disc 431 a sensor SE11 will detect the small holes to generate pulse signals. By counting the number of pulses output from the sensor SE11 it is possible to detect the quantity of movement of the first chucking device 415, and when a predetermined number of pulses has been counted, the motor M2 is turned off. In this way, the quantity of movement of the first chucking device 415 can be accurately controlled. The stacking tray 411 is provided with an elongated slot 411*a* (see FIG. 20) which enables the friction plates 417*a* and 418*a* to grasp a sheet set and shift in the direction indicated with an arrow h.

As FIG. 3 shows, the leading end of the spiral shaft 426 extends to a location adjacent to the stapling station 440 such that the first chucking device 415 is shiftable to this location. In this case, the leading edge of a sheet set held between the friction plates 417*a* and 418*a* gets caught between transport rollers 469 and 470 and thereafter the sheet set is transported by the transport rollers 469 and 470.

(Lead Stopper)

Figure 8:
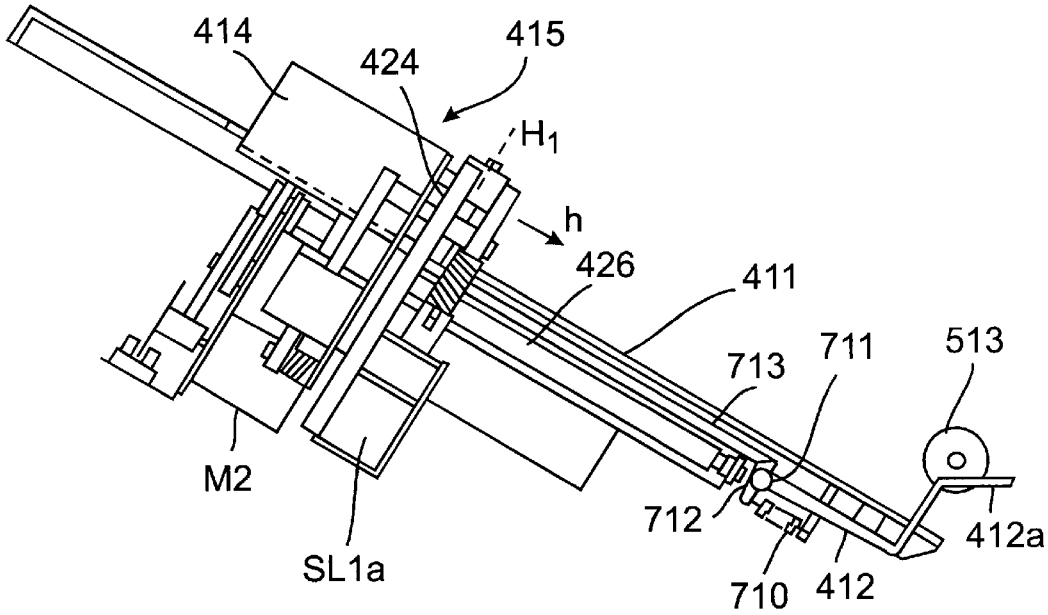
FIG. 8 is a partially sectional view which shows an operation of a leading edge stopper (when regulating)

As FIG. 8 shows, the lead stopper 412 is pivotally mounted on the leading end of the stacking tray 411 such that when a cam 712 fixed integrally with the stopper 412 is biased by a spring 710, the stopper 412 pivots counterclockwise so that its front end projects over the tray 411 to regulate the leading edges of sheets. The stopper 412 has a comb teeth shape, and as FIG. 4 shows, it projects upward from notches 411*c* at the leading portion of the tray 411. The leading end of a lever 713 fixed to the bracket 424 of the first chucking device 415 abuts against an inclined upper end surface of the cam 712.

Figure 9:
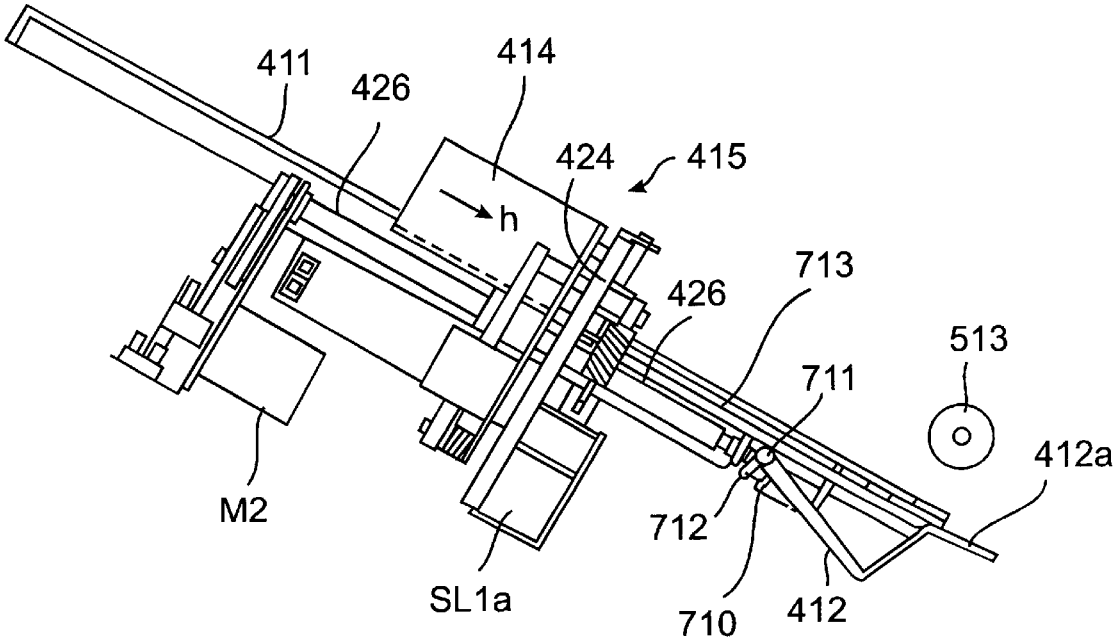
FIG. 9 is a partially sectional view which shows an operation of the leading edge stopper (when releasing regulation)

As stated earlier, a set of sheets stacked on the stacking tray 411 is gripped by the first chucking device 415 and is transported in the direction indicated with the arrow h by the motor M2 (spiral shaft 426) being driven forward. In this conjunction, the lever 713 shifts integrally with the first chucking device 415 in the direction indicated with the arrow h to pivot the cam 712 clockwise as shown in FIG. 9. At the same time, the lead stopper 412 pivots about the pin 711 in the clockwise direction to retreat to the underside of the tray 411. While a set of sheets is being transported, that is, while the first chucking device 415 is in an advanced position relative to the home position $H_1$, the cam 712 is held down by the lever 713 so that the lead stopper 412 is held on the back side of the tray 411 to permit the transport of sheets. When the stopper 412 is in its retreating condition, a leading portion 412*a* of the stopper 412 is positioned substantially flush with the tray 411 and guides the downside of the sheet set being transported. This enables smooth delivery of the sheet set from the tray 411 to the stapling station 440.

Upon delivery of a sheet set to the stapling station 440, the solenoid SL1*a* is turned off to enable the friction plates 417*a* and 418*a* to release the sheet set, and simultaneously therewith, the motor M2 is driven reverse to cause the first chucking device 415 to return to the home position $H_1$. When the first chucking device 415 returns to the home position $H_1$, the lever 713 releases the cam 712 from its bias so that the lead stopper 412 pivots upward to prepare for a next sheet set to be received.

(Second Chucking Device)

Figure 10:
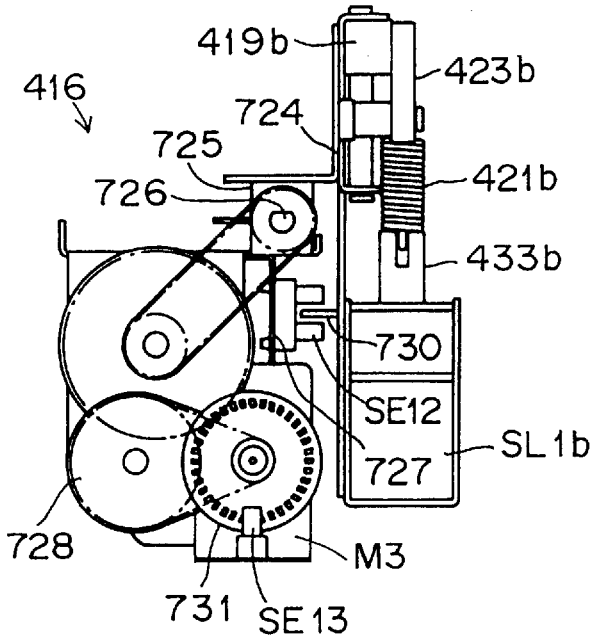
FIG. 10 is a front view which shows a second chucking device.
Figure 11:
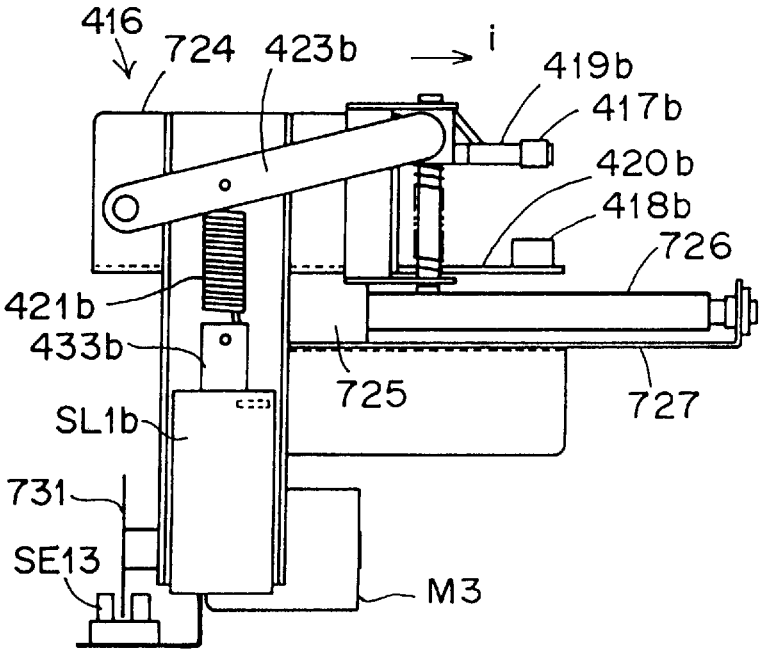
FIG. 11 is a side elevational view which shows the second chucking device.

As FIGS. 10 and 11 show, the second chucking device 416 comprises friction plates 417*b* and 418*b* made of a resilient material, support plates 419*b* and 420*b* for supporting them, a solenoid SL1*b* for moving the friction plate 417*b* upward and downward, and a support plate 724 for supporting these members. The solenoid SL1*b* has a plunger 433*b* which is connected to the support plate 419*b* through a spring 421*b* and a lever 423*b*, so that when the solenoid SL1*b* is turned on, the friction plate 417*b* moves downward in conjunction with the support plate 419*b* to resiliently grasp, in cooperation with the friction plate 418*b*, a side of a sheet set on the stacking plate 411. This arrangement is identical with that of the first chucking device 415.

Further, the second chucking device 416 is reciprocally movable in a direction indicated with the arrow i perpendicular to the direction indicated with the arrow h from a home position $H_2$ shown with a solid line in FIG. 4 and to a position at which sheet P can be grasped at a side. For the purpose of this movement, a nut member 725 fixed to the support plate 724 is threadingly fitted on a spiral shaft 726. The spiral shaft 726 is rotatably mounted to a frame 727 and is adapted to be forward/reverse driven by a motor M3 through a drive transmission 728 which comprises gears and belts. That is, through forward run of the motor M3, the spiral shaft 726 rotates forward to cause the second chucking device 416 to advance in the direction indicated with the arrow i, and through reverse run of the motor M3, the second chucking device 416 is caused to retreat. The presence of the second chucking device 416 in its home position $H_2$ is detected upon entry of a light shield plate 730 fixed to the support plate 724 into the optical axis of a sensor SE12 disposed on the frame 727.

On the output shaft of the motor M3 there is fixed a disc 731 having a plurality of small holes formed regularly along a circumferential edge portion thereof such that on the basis of the rotation of the disc 731 a sensor SE13 will detect the small holes to generate pulse signals. By counting the number of pulses output from the sensor SE13 it is possible to detect the quantity of movement of the second chucking device 416, and when a predetermined number of pulses has been counted, the motor M3 is turned off. In this way, the quantity of movement of the second chucking device 416 can be accurately controlled. The stacking tray 411 is formed with an elongated slot 411*b* (see FIG. 4) which enables the friction plates 417*b* and 418*b* to grasp a sheet set and shift in the direction indicated with the arrow i.

Sheets to be received onto the stacking tray 411 may be varied in size, from B5Y minimum to A3T maximum. This second chucking device 416, as is the case with the side alignment plate 413, is adapted to advance to a position at which it can grasp a side of sheets aligned by the alignment plate 413 and reference plate 414 in response to a sheet size signal transmitted from the controller of the copying machine 10 to the controller of the finisher 40.

(Chucking Operation)

In the present embodiment, the first chucking device 415 is operated in the following three modes.

In a first mode, the first chucking device 415, alternately with the second chucking device 416, grasps a side of sheets stacked/aligned on the stacking tray 411, one sheet at a time. This alternate chucking operation is carried out in case that the sheet folding mode is selected. In the case of non-folded sheets being stapled, the first chucking device 415 is on standby at the home position $H_1$. In the case of alternate chucking operation, the motor M2 is run forward, and the first chucking device 415, as shown in FIG. 4, moves from the home position $H_1$ to a position Q opposed to the second chucking device 416 irrespective of sheet size. In the position Q, the solenoids SL1*a* and SL2 are off and the friction plates 417*a* and 418*a* are in their retreating condition at a location outside the alignment reference line A of the reference plate 414. The second chucking device 416 is on standby at its home position $H_2$.

When sheet P is discharged onto the stacking tray 411, the alignment plate 413 advances by a predetermined quantity in the direction indicated with the arrow i from the home position in response to a trailing edge detection signal from the sensor SE5 so as to align the sheet P between the alignment plate 413 and the reference plate 414. Next, the solenoid SL2 is turned on in response to an advance end signal of the alignment plate 413, and the friction plates 417*a* and 418*a* advance to a position for grasping the side of the aligned sheet P. Thereupon, the solenoid SL1*a* is turned on, and the friction plates 417*a* and 418*a* grasp the side of the sheet P. At the end of the chucking operation, the alignment plate 413 returns to the home position.

When a next sheet is discharged onto the tray 411, in the same manner as described above, the alignment plate 413 advances by the predetermined quantity, and in synchronism with this, the second chucking device 416 advances a predetermined quantity in the direction indicated with the arrow i from the home position $H_2$. Next, the solenoid SL1*b* is turned on in response to an advance end signal of the alignment plate 413, and the friction plates 417*b* and 418*b* grasp the side of the sheets. Almost simultaneously with this, the alignment plate 413 returns to its home position, and the solenoid SL1*a* of the first chucking device 415 is turned off so that the friction plates 417*a* and 418*a* release the sheets. Then, the solenoid SL2 is turned off and the friction plates 417*a* and 418*a* retreat outward from the sheets. When a next sheet is received, the second chucking device 416 releases the sheet set, then retreats, and the first chucking device 415 grasps the sheet set.

In this way, the chucking devices 415 and 416 alternately repeat advancing to and retreating from the chucking position to hold sheets successively delivered onto the stacking tray 411.

By virtue of this chucking operation of the first mode, it is possible to prevent any float up of sheets and also to design the stacking tray 411 to be of a larger loading capacity. In particular, this operation is advantageous in collecting two-folded and Z-folded sheets onto the stacking tray 411.

In a second mode, the first chucking device 415 grasps a set of sheets on the stacking tray 411 at the home position $H_1$ and transports the sheet set by a distance $L_4$ in the direction indicated with the arrow h (see FIG. 4). This is done for the purpose of setting the leading portion of the sheet set on the stapling position X (X denotes a stapling position in the direction of sheet transport as in FIG. 3) in order to staple the sheet set at the leading portion.

In this second mode, when a set of sheets is aligned on the tray 411, the second chucking device 416 is held on standby at its home position $H_2$, and the first chucking device 415 grasps the sheet set at its home position $H_1$, and through forward run of the motor M2, it advances by the distance $L_4$. In this conjunction, the lead stopper 412 pivots downward to release the leading edge regulation as already described. The sheet set which has been transported by the distance $L_4$ is stapled at the leading portion thereof.

At the end of the stapling operation, the motor M2 is driven forward while the first chucking device 415 still grasps the sheet set, so that the first chucking device 415 shifts further in the direction indicated with the arrow h and delivers the sheet set to the transport rollers 469 and 470. In this case, the halting of the first chucking device 415 is controlled by pulse signals from the sensor SE11. Then, the first chucking device 415, the solenoids LSla and SL2 are turned off, and the motor M2 is driven reverse, whereupon the first chucking device 415 returns to its home position $H_1$.

In a third mode, the first chucking device 415 grasps a set of sheets on the stacking tray 411 at the home position $H_1$ and transports the sheet set by a distance $L_3$ in the direction indicated with the arrow h until the leading portion of the sheet set is drawn in between the transport rollers 469 and 470 (see FIG.4). This is done for the purpose of stapling the sheet set at the center portion thereof or at the trailing portion thereof.

In this third mode, when a set of sheets is aligned on the tray 411, the second chucking device 416 is held on standby at its home position $H_2$, and the first chucking device 415 grasps the sheet set at its home position $H_1$, and through forward run of the motor M2, it advances by the distance $L_3$. In this conjunction, the lead stopper 412 pivots downward to release the leading edge regulation as already described. The halting of the first chucking device 415 at the distance $L_3$ is controlled by pulse signals from the sensor SE11. Then, the solenoids SL1*a* and SL2 are turned off and the motor M2 is driven reverse, whereupon the first chucking device 415 returns to its home position $H_1$. The sheet set is transported further by the transport rollers 469 and 470 in the direction indicated with the arrow h for being stapled as will be hereinafter described.

(Stapling Station)

As shown in FIG. 3, the stapling station 440 comprises the stapling unit 441 and a sheet set transport unit 465.

(First Embodiment of Stapling Unit)

Figure 12:
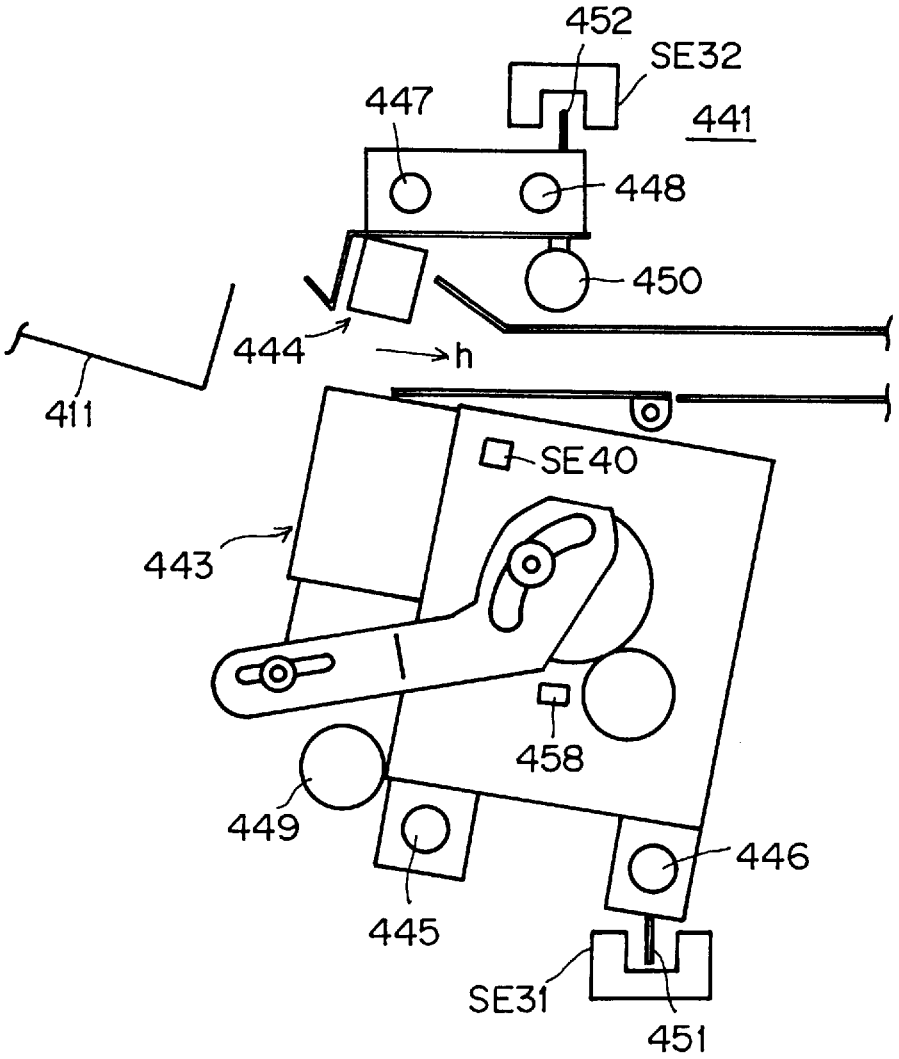
FIG. 12 is a front view which shows a stapling unit which is the first embodiment.
Figure 13:
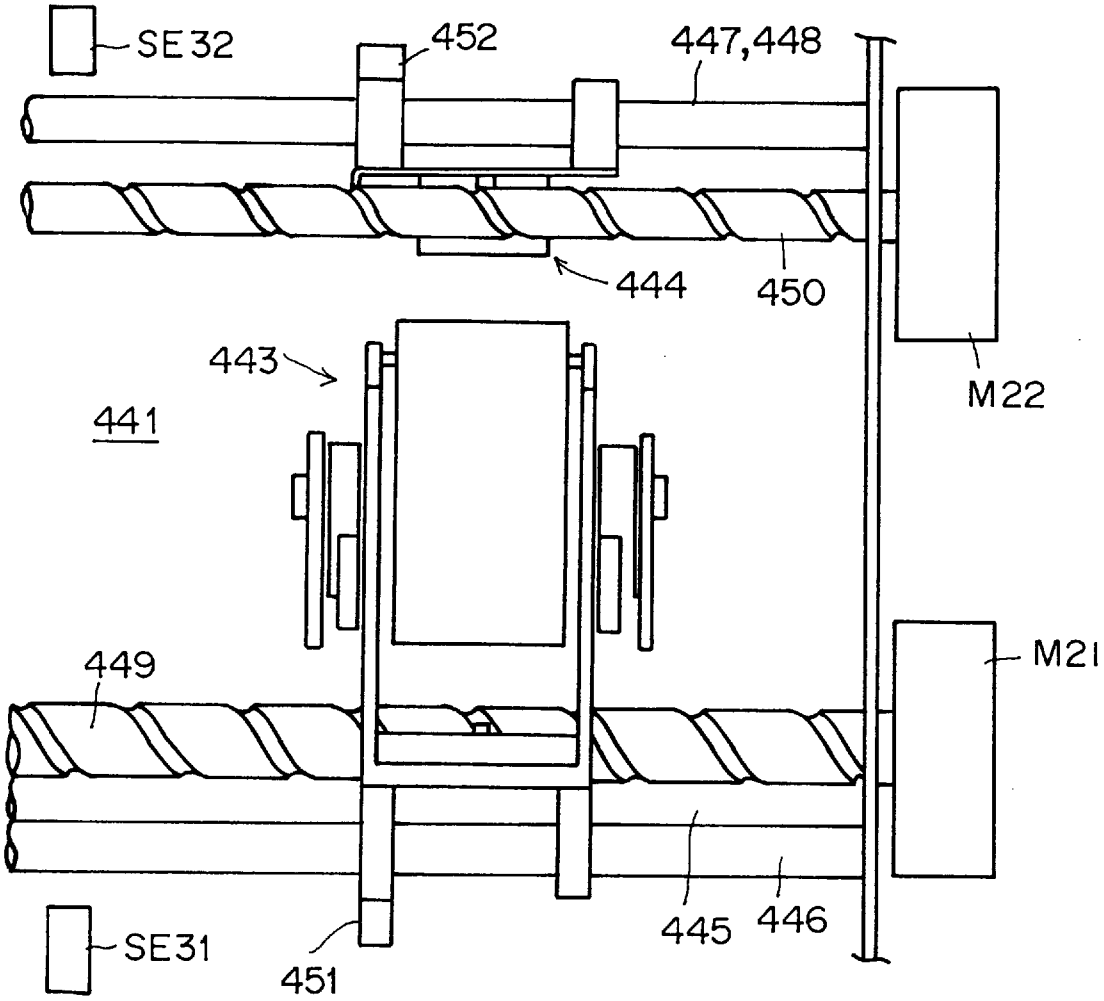
FIG. 13 is a side elevational view which shows the stapling unit.

The stapling unit 441, as shown in FIGS. 12 and 13, comprises a staple head 443 which discharges staples and a staple anvil 444 which receives and bends discharged staples. The staple head 443 and the staple anvil 444 are independently movably disposed. The staple head 443 is slidably mounted on two guide shafts 445 and 446 and is movable in a direction perpendicular to the direction indicated with an arrow h in conjunction with the forward/reverse run of a spiral shaft 449 driven by a stepping motor M21. The staple anvil 444 is slidably mounted on two guide shafts 447 and 448 and is movable in a direction perpendicular to the direction indicated with the arrow h in conjunction with the forward/reverse run of a spiral shaft 450 driven by a stepping motor M22.

The staple head 443 and the staple anvil 444 have light shield plates 451 and 452 fixed respectively thereto and positions at which the shield plates 451 and 452 are detected by light transmission type sensors SE31 and SE32 are respective home positions of the staple head 443 and the staple anvil 444. The stepping motors M21 and M22 are controllable by the number of driving pulses with respect to their number of revolutions, and the staple head 443 and the staple anvil 444 can be stopped at any desired position independently of each other.

Figure 14:
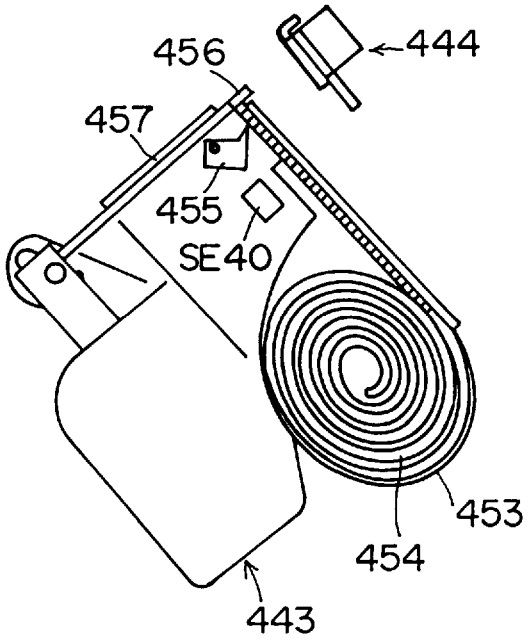
FIG. 14 is a front view which shows an internal structure of the stapling unit.

As shown in FIG. 14, the staple head 443 incorporates a staple cartridge 453. The staple cartridge 453 is of the well known type which is removably mountable to the staple head 443 and has staples 454 housed therein. Staples 454 are individually arranged parallel and adhesively joined into a planar-form assembly which is accommodated within the staple cartridge 453 in a rolled-up condition.

The staple head 443 includes a staple feed member 455, a staple severing member 456 and a staple bending member 457, and pivots to a side of the staple anvil 444 to sever and separate staples 454 one at a time, and each severed staple is bent in U shape and driven into a sheet set. The staple feed member 455 turns intermittently in response to such driving operation to feed staples 454 one pitch at a time. The staple head 443 has a sensor SE40 for detecting the presence or non-presence of staples 454 in the staple cartridge 453 and a detecting device 458 for detecting a staple jam. The detecting device 458 detects a staple jam by, for example, detecting load applied to a staple motor (not shown).

Next, the manner of the stapling operation by the stapling unit 441 will be explained. When a set of sheets is stored in the stacking tray 411, the set of sheets is transported by the first chucking means 415 from the tray 411 in a direction indicated with the arrow h. When the sheet set stops at a predetermined point, the staple head 443 and the staple anvil 444 arc caused to move from their home positions to stapling points by driving the stepping motors M21 and M22. When the staple head 443 and the staple anvil 444 stop at a specified stapling point, the staple head 443 begins operation to drive staples into the sheet set. If there are plural stapling points, the staple head 443 and the staple anvil 444 move sequentially to stapling points while performing stapling operation in the mean time.

(Sheet Set Transport Unit)

As shown in FIGS. 2 and 3, the sheet set transport unit 465 comprises transport rollers 469 and 470 and a transport roller pair 474. The transport roller 469 is shiftable by means of a solenoid (not shown) toward and away from the transport roller 470. When a sheet set is delivered by the first chucking device 415, the transport roller 469 is moved away from the transport roller 470 so as to permit the sheet set to be received between the rollers 469 and 470 and is thereafter operative to transport the sheet set in cooperation with the transport roller 470. The sheet set transported through this transport unit 465 is fed into the earlier described transport path 52 through a transport roller pair 474, and the sheet set is delivered, while being decelerated, from the discharge roller pair 524 onto the storing tray 475.

(Control Panel)

Figure 15:
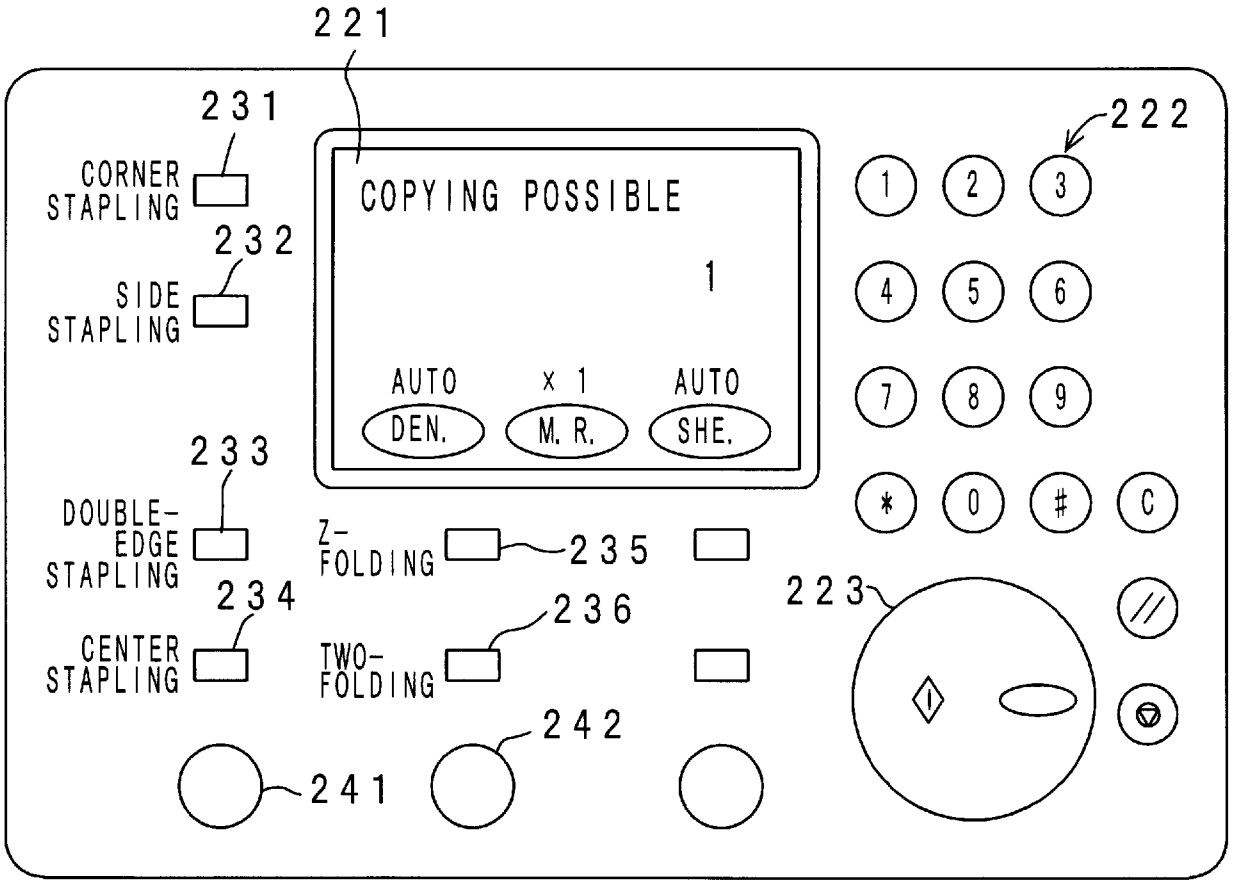
FIG. 15 is a plan view which shows an operation panel.

FIG. 15 shows a control panel 220 mounted on the copying machine 10. Disposed on the control panel 220 are a liquid crystal touch panel 221, a ten-key 222, a copy start key 223, a stapling mode selector key 241, a folding mode selector key 242, a corner stapling mode indicator 231, a side stapling mode indicator 232, a double-edge stapling mode indicator 233, a center stapling mode indicator 234, a Z-folding mode indicator 235, and a two-folding mode indicator 236.

Each time the stapling mode selector key 241 is pressed one time, indicators 231 through 234 light in sequential order, and an applicable selection mode is selected. Each time the folding mode selector key 242 is pressed one time, indicators 235 and 236 light sequentially, and an applicable folding mode is selected.

(Control Section)

Figure 16:
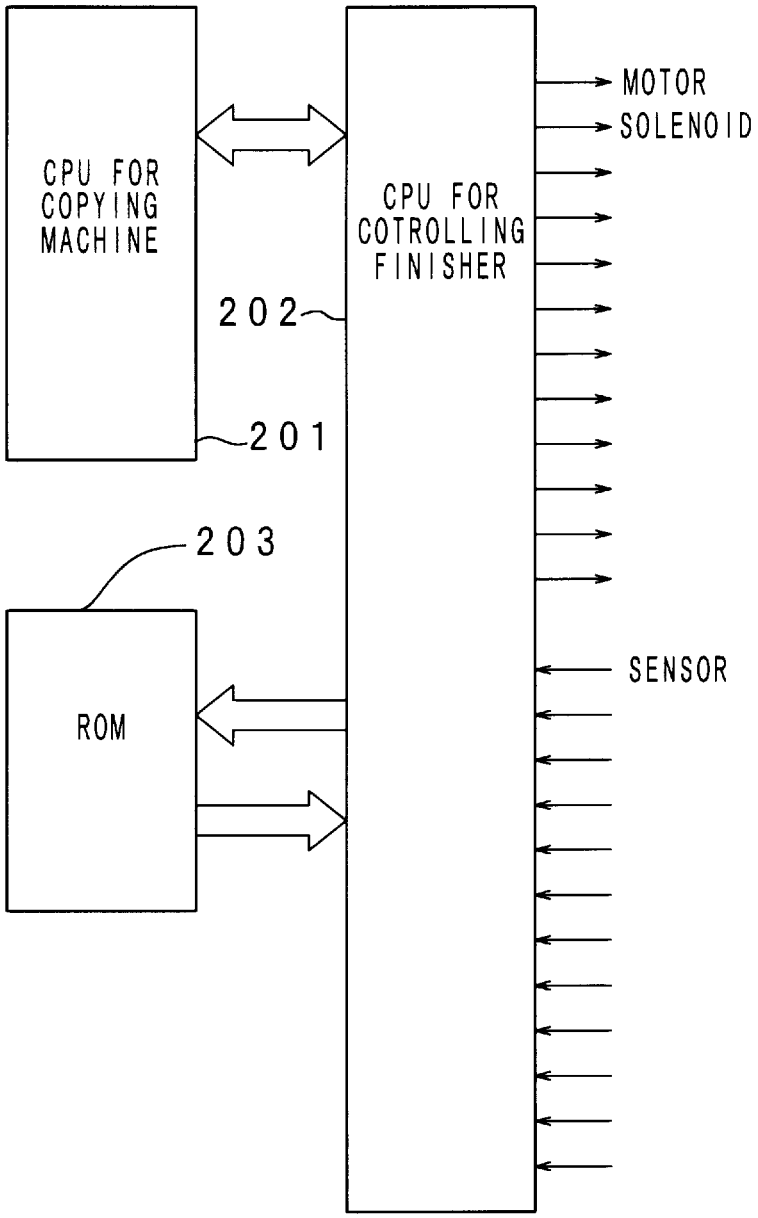
FIG. 16 is a block diagram which shows a control section.

FIG. 16 shows the control section of the copying system which comprises, as main units, a CPU 201 for controlling the copying machine 10, and a CPU 202 for controlling the finisher 40. The CPU 202 includes a ROM 203 having control information stored therein and issues control signals to the loads of various motors, solenoids, etc. The CPU 202 also receives detection signals from detectors, such as sheet detecting sensors.

(Control Procedure)

Figure 17:
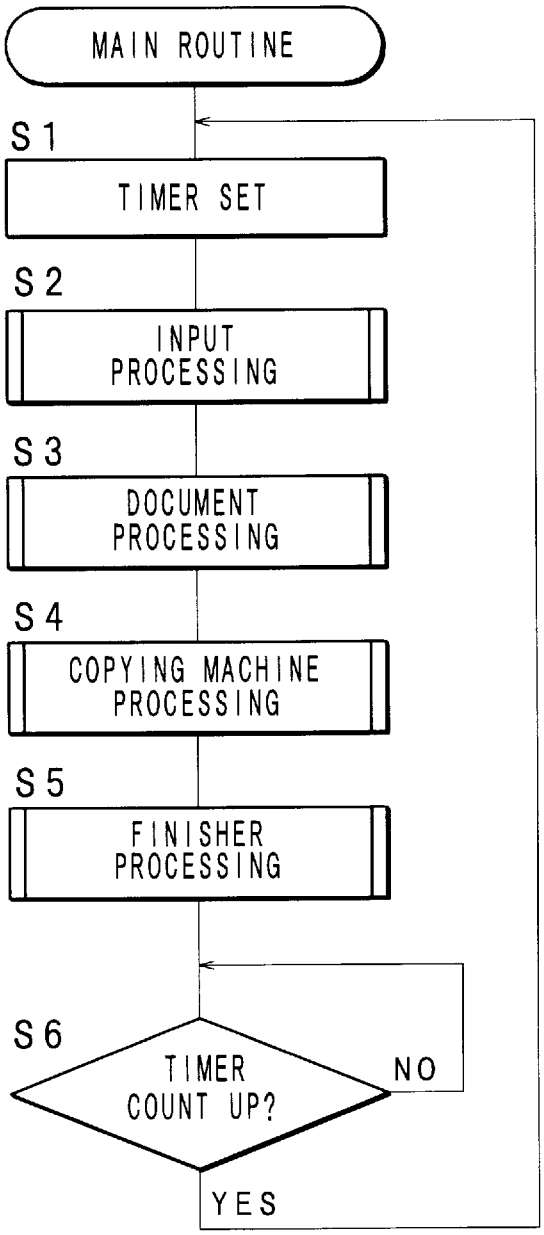
FIG. 17 is a flowchart which shows a main routine of control procedure.

FIG. 17 shows a main routine of the copying system. At step S1, an internal timer is set, and at step S2, an appropriate processing mode is determined on the basis of information input from the control panel 220.

Next, at step S3, the ADF 20 is operated to run documents one round to count the number of documents and at the same time, decision is made whether or not staple processing is possible in relation to processing mode. Next, at step S4, the copying machine 10 is operated to carry out copying, and at step S5, the finisher 40 is operated to process sheets in a predetermined mode. At step S6, when count up of the internal timer is verified, the controller returns to step S1.

Figure 18:
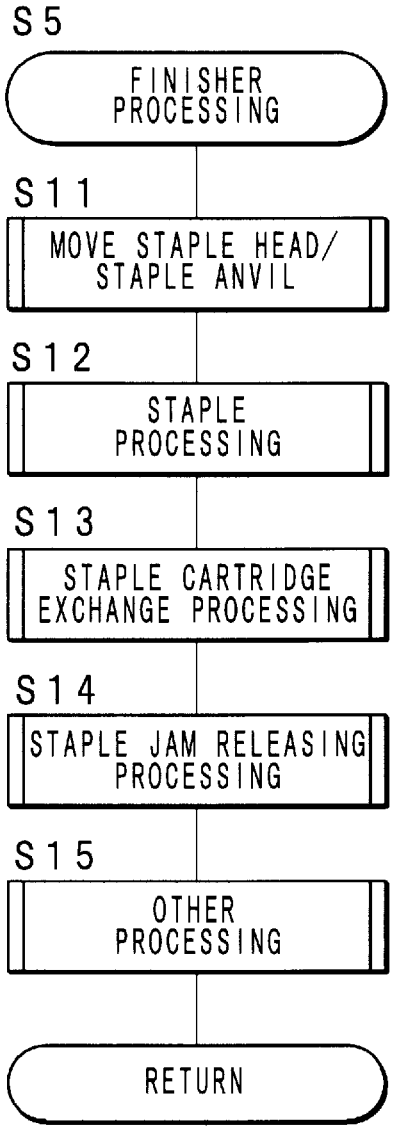
FIG. 18 is a flowchart which shows a subroutine of finisher processing (in accordance with the first embodiment)

FIG. 18 shows a subroutine of finishing process which is carried out at steps 5 of the main routine. In this subroutine, the staple head 443 and the staple anvil 444 are moved to a specified stapling point at step S11, and the staple head 443 drives staples into the sheet set at step S12. Next, at step S13, if the staple cartridge is empty, the staple cartridge exchange processing is carried out, and at step S14, if a staple jam occurs, staple jam releasing processing is carried out. Further, at step S15, other necessary processing such as transporting a sheet set is carried out.

Figure 19A:
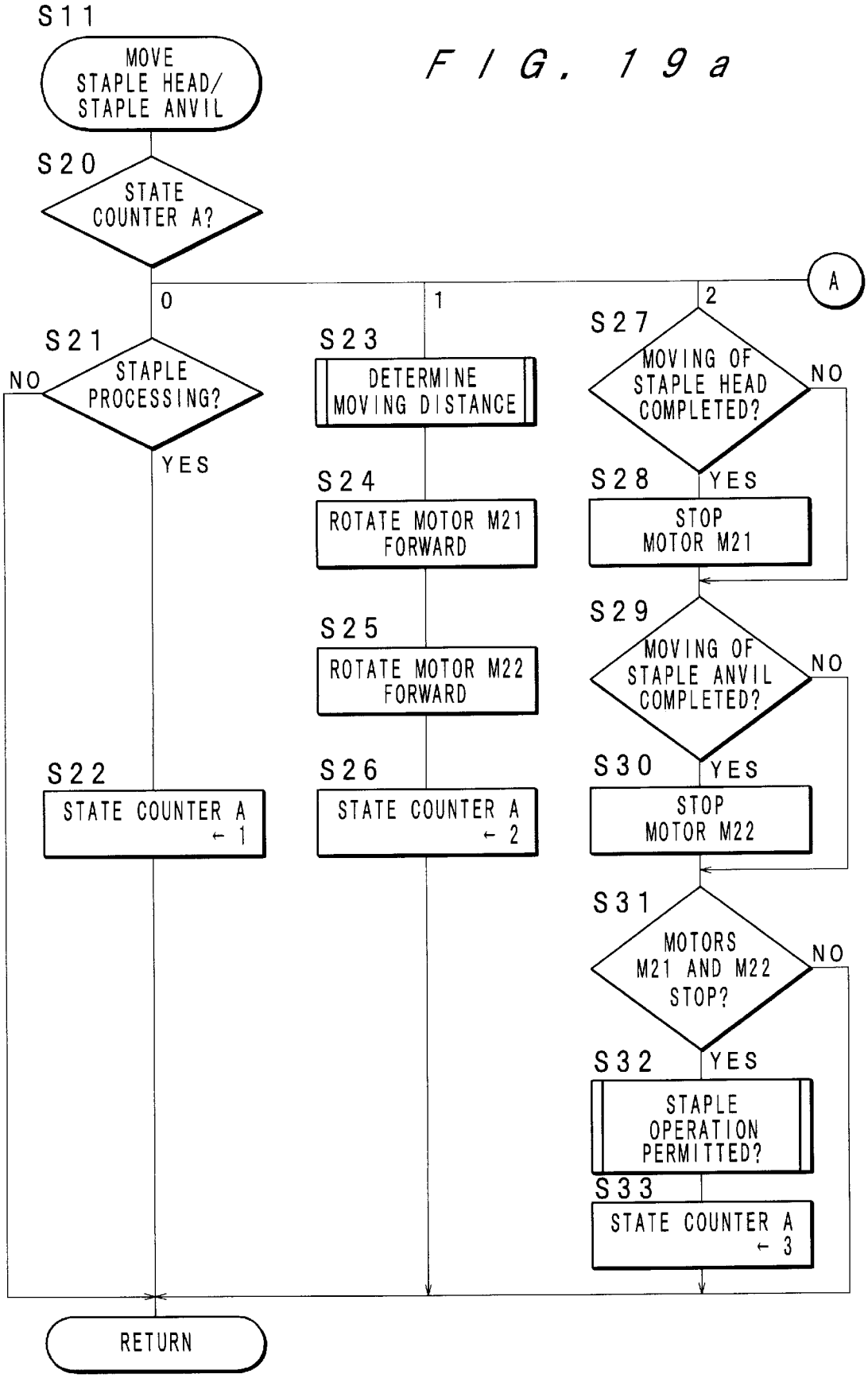
FIGS. 19*a* and 19*b* are flowcharts which show a subroutine of a staple head movement and a staple anvil movement.
Figure 19B:
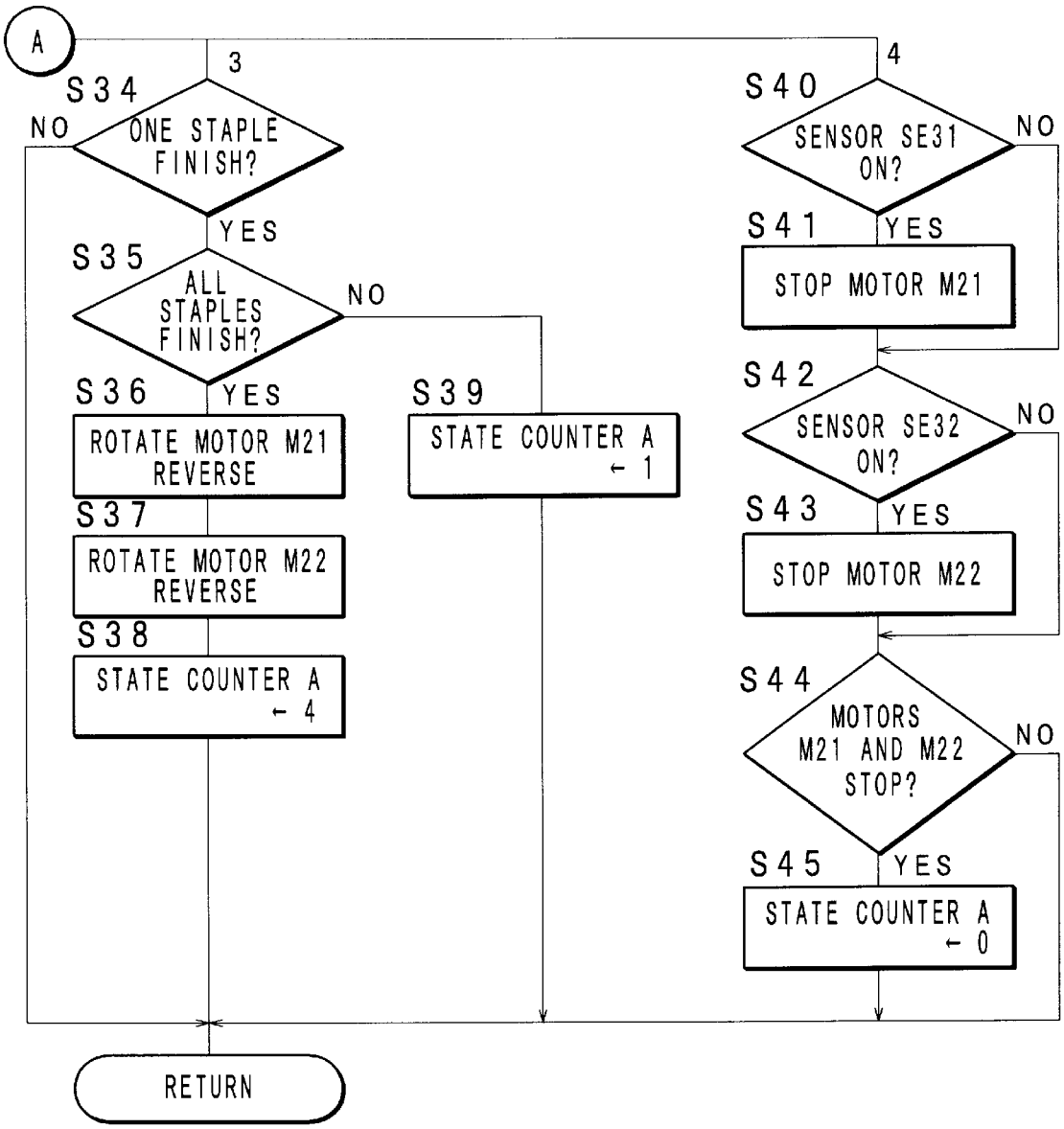

FIGS. 19*a* and 19*b* show a subroutine of moving the staple head 443 and the staple anvil 444 which is carried out at step S11. In this subroutine, a count value (an initial value is "0") of a state counter A is checked, and following processing is carried out according to the count value.

When the state counter A is "0", whether the staple processing is to be carried out or not is judged at step S21. If the staple processing is to be carried out, the state counter A is set to "1" at step S22.

When the state counter A is "1", a moving distance of the staple head 443 and the staple anvil 444 to a staple point is determined at step S23. Next, at steps S24 and S25, the stepping motors M21 and M22 are rotated forward, and the state counter A is set to "2" at step S26.

When the state counter A is "2", if it is judged that moving of the staple head 443 is completed at step S27, the stepping motor M21 is stopped at step S28. Further, if it is judged that moving of the staple head 444 is completed at step S29, the stepping motor M22 is stopped at step S30. Next, when it is confirmed that both the stepping motors M21 and M22 are stopped, the staple operation is permitted at step S32, and the state counter A is set to "3" at step S33.

When the state counter A is "3", whether driving one staple is finished or not is judged at step S34. If driving one staple is finished (YES at step S34), whether driving all necessary staples are completed or not is judged at step S35. When stapling at a plurality of points is to be carried out, the state counter A is set to "1" at step S39, and the above-mentioned steps S23 through S33 are repeated. After driving all the staples are completed, the stepping motors M21 and M22 are rotated reverse at steps S36 and S37, and the state counter A is set to "4" at step S38.

When the state counter A is "4", with confirming that the sensor SE31 is turned on at step S40, that is, that the staple head 443 goes back to the home position, the stepping motor M21 is stopped at step S41. Further, with confirming that the sensor SF32 is turned on at step S42, that is, that the staple anvil 444 goes back to the home position, the stepping motor M22 is stopped at step S43. Next, with confirming that both the stepping motors M21 and M22 are stopped at step S44, the state counter A is reset to "0" at step S45.

Figure 20A:
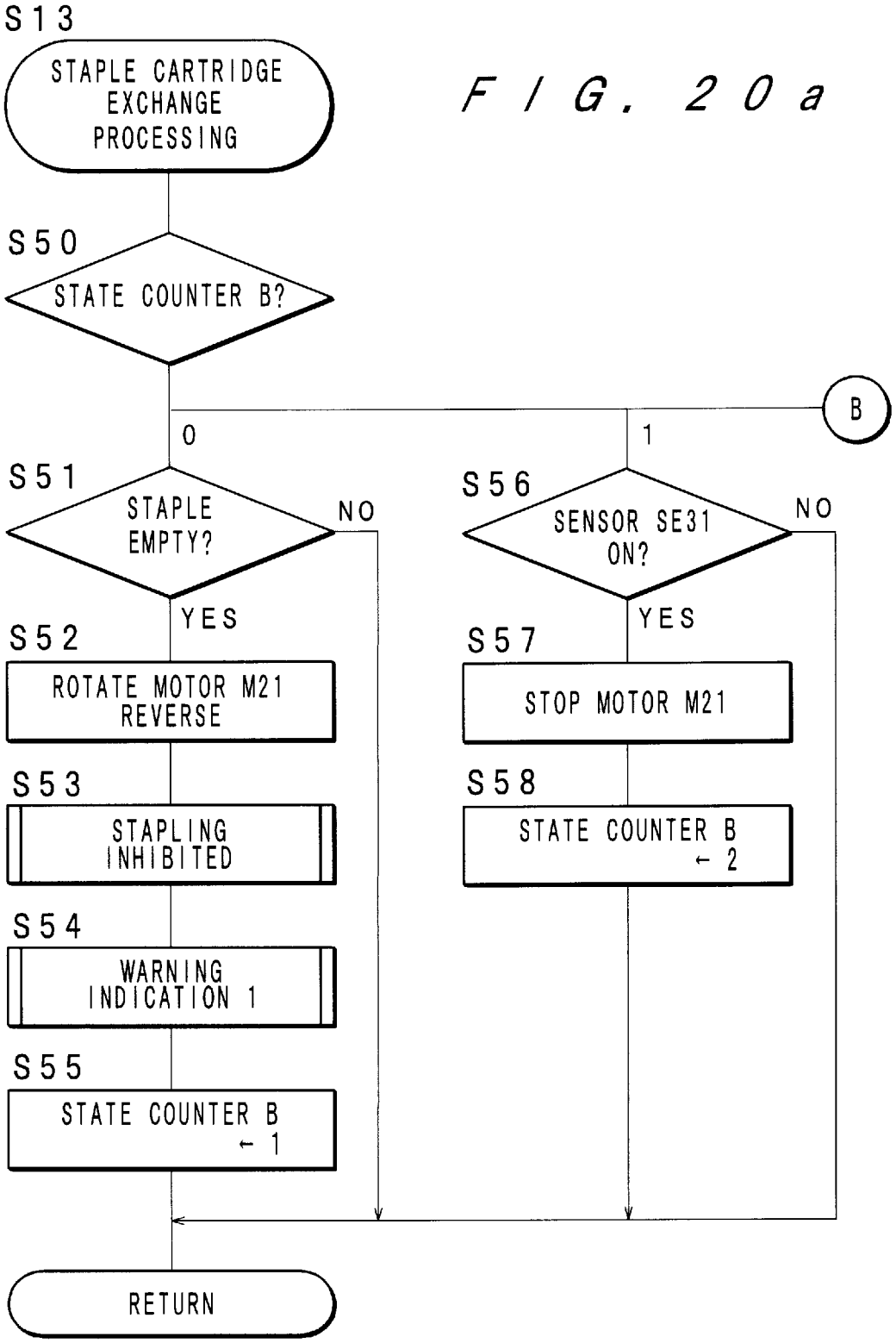
FIGS. 20*a* and 20*b* are flowcharts which show a subroutine of staple cartridge exchange processing.
Figure 20B:
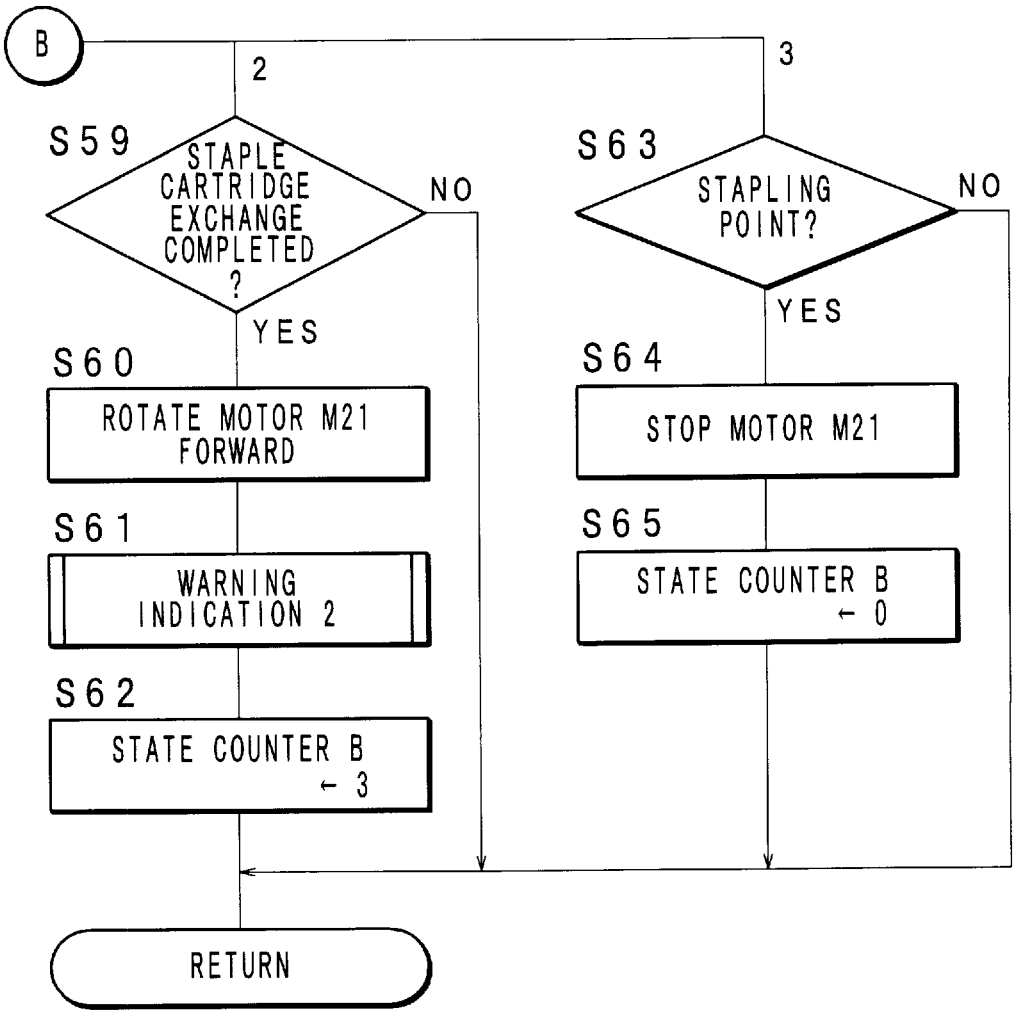

FIGS. 20*a* and 20*b* show a subroutine of the staple cartridge exchange processing which is carried out at step S13. In this subroutine, a count value (an initial value is "0") of a state counter B is checked at step S50, and following processing is carried out according to the count value.

When the state counter B is "0", whether the staple cartridge 453 is empty or not is judged by on and off of a sensor SE40 at step S51. If the staple cartridge 453 is empty, the stepping motor M21 is rotated reverse at step S52, and stapling is inhibited at step S53. Simultaneously, a warning indication 1 is processed at step S54. The warning indication 1 into indicate sentences "Staples empty. Exchange staple cartridge" on the operation panel 220. Next, the state counter B is set to "1" at step S55.

When the state counter B is "1", with confirming that the sensor SE31 is turned on at step S56, that is, with the staple head 443 going back to the home position which is the staple cartridge exchange position, the stepping motor M21 is stopped at step S57. Next, the state counter B is set to "2"at step S58.

When the state counter is "2", whether an exchange of the staple cartridge 453 is completed or not is judged at step S59. The completion of the exchange is judged from turning-on the sensor 40, that is, detection of the presence of staples by the sensor SE40. After the exchange of the staple cartridge 453, the stepping motor M21 is rotated in the forward direction at step S60, and a warning indication 2 is processed at step S61. The warning indication 2 is to indicate a sentence "Staple head is moving to stapling point." on the operation panel 220. Next, the state counter B is set to "3" at step S62.

When the state counter B is "3", with confirming that the staple head 443 is moved to the stapling point at step S63, the stepping motor M21 is stopped at step S64. Next, the state counter B is reset to "0" at step S65.

Figure 21A:
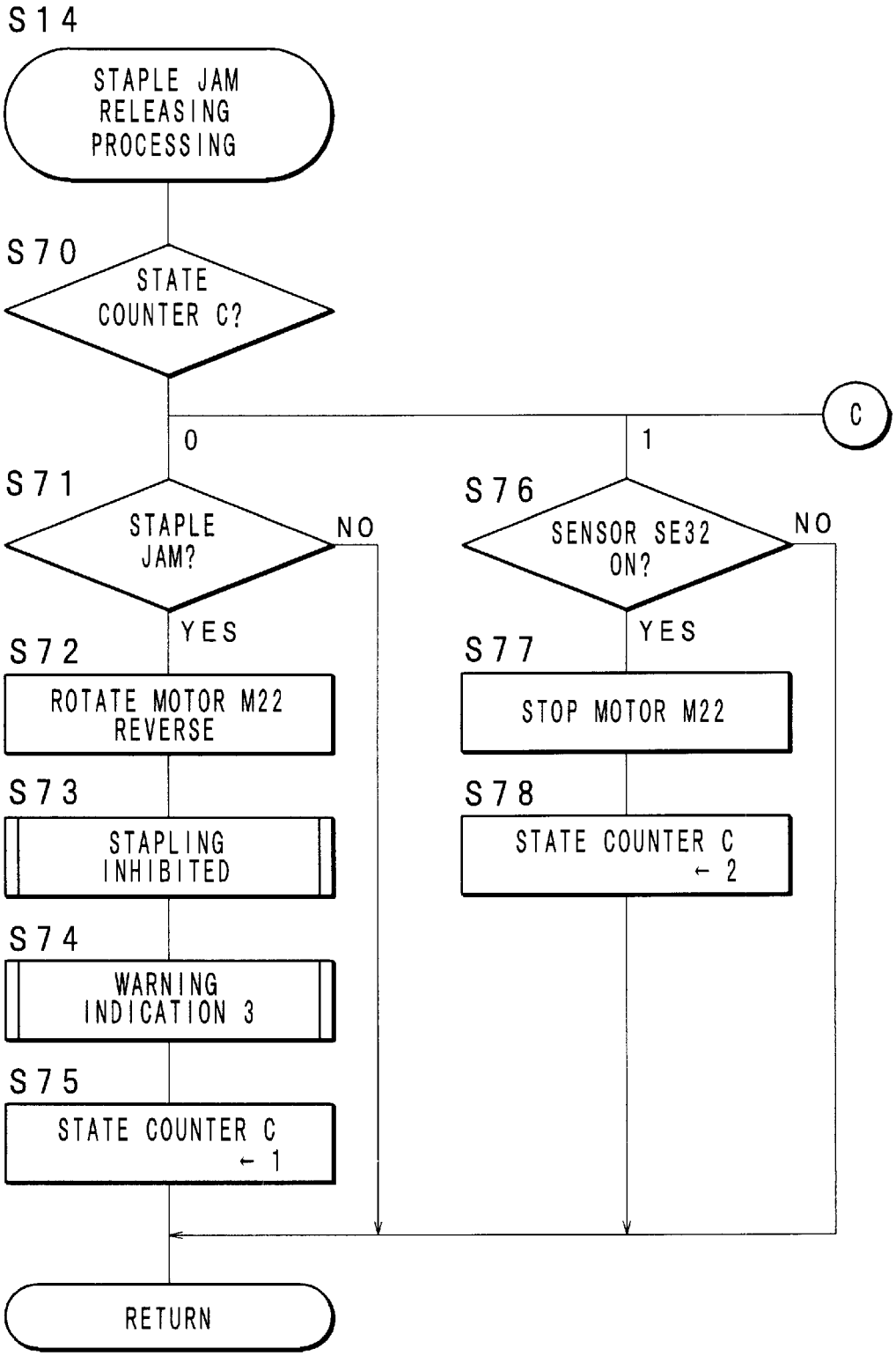
FIGS. 21*a* and 21*b* are flowcharts which show a subroutine of staple jam release processing.
Figure 21B:
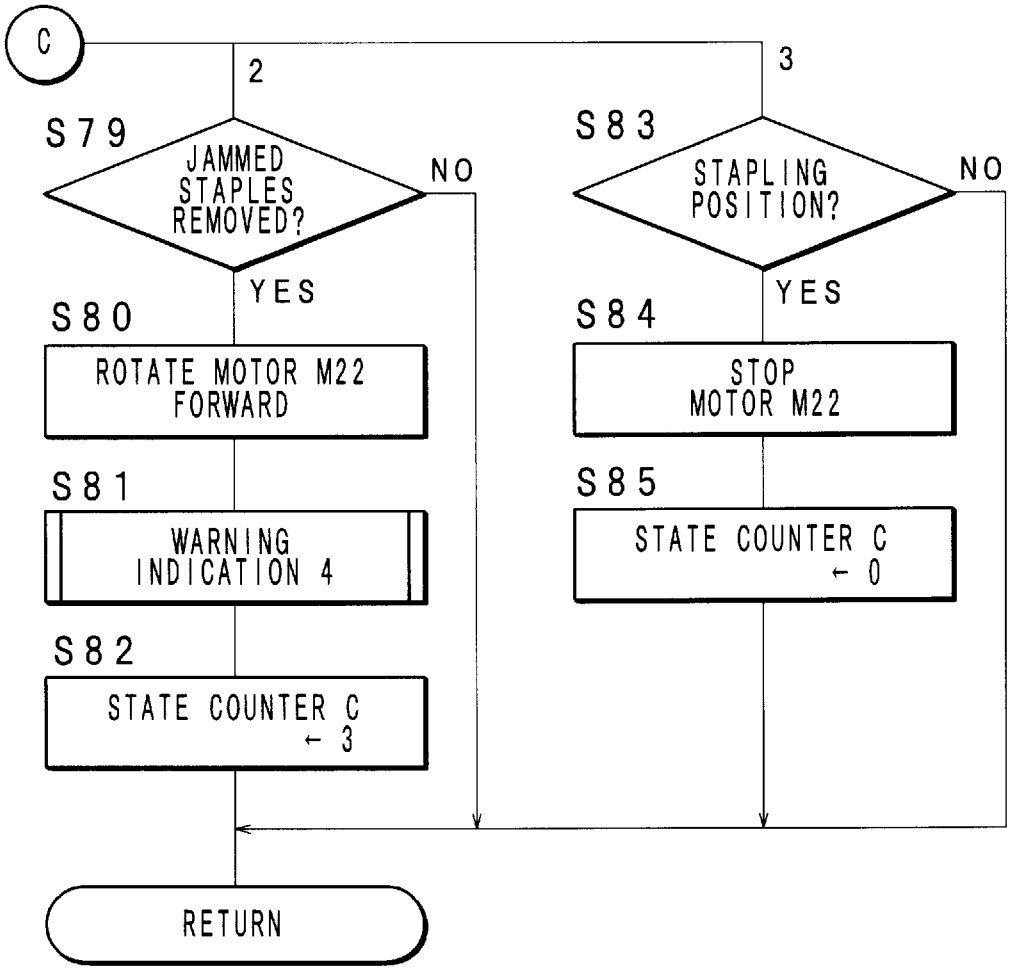

FIGS. 21*a* and 21*b* show a subroutine of staple jam releasing processing which is carried out at step S14. In this subroutine, a count value (an initial value is "0") of a state counter C is checked at step S70, and following processing is carried out according to the count value.

When the state counter C is "0", whether a staple jam occurs or not is judged by a signal from the detecting device 458 at step S71. When a staple jam occurs, the stepping motor M22 is rotated in the reverse direction at step S72, and stapling is inhibited at step S73. Simultaneously, a warning indication 3 is processed at step S74. The warning indication 3 is to indicate sentences "Staple jam occurred. Remove jammed staples." on the operating panel 220. Next, the state counter C is set to "1".

When the state counter C is "1", with confirming that the sensor SE32 is turned on at step S74, that is, with the staple anvil 444 going back to the home position, the stepping motor M22 is stopped at step S77. Next, the state counter C is set to "2" at step S78.

When the state counter C is "2", whether the jammed staples were removed or not is judged at step S79. If the jammed staples were removed, the stepping motor M22 is rotated forward at step S80, and a warning indication 4 is processed at step S81. The warning indication 4 is to indicate a sentence "Staple head is moving to staple point" on the operation panel 220. Next, the state counter C is set to "3"at step S82.

When the state counter C is "3", with confirming that the staple anvil 444 is moved to a staple point at step S83, the stepping motor M22 is stopped at step S84. Next, the state counter C is reset to "0" at step S85.

(Second Embodiment of Stapling Unit)

Figure 22:
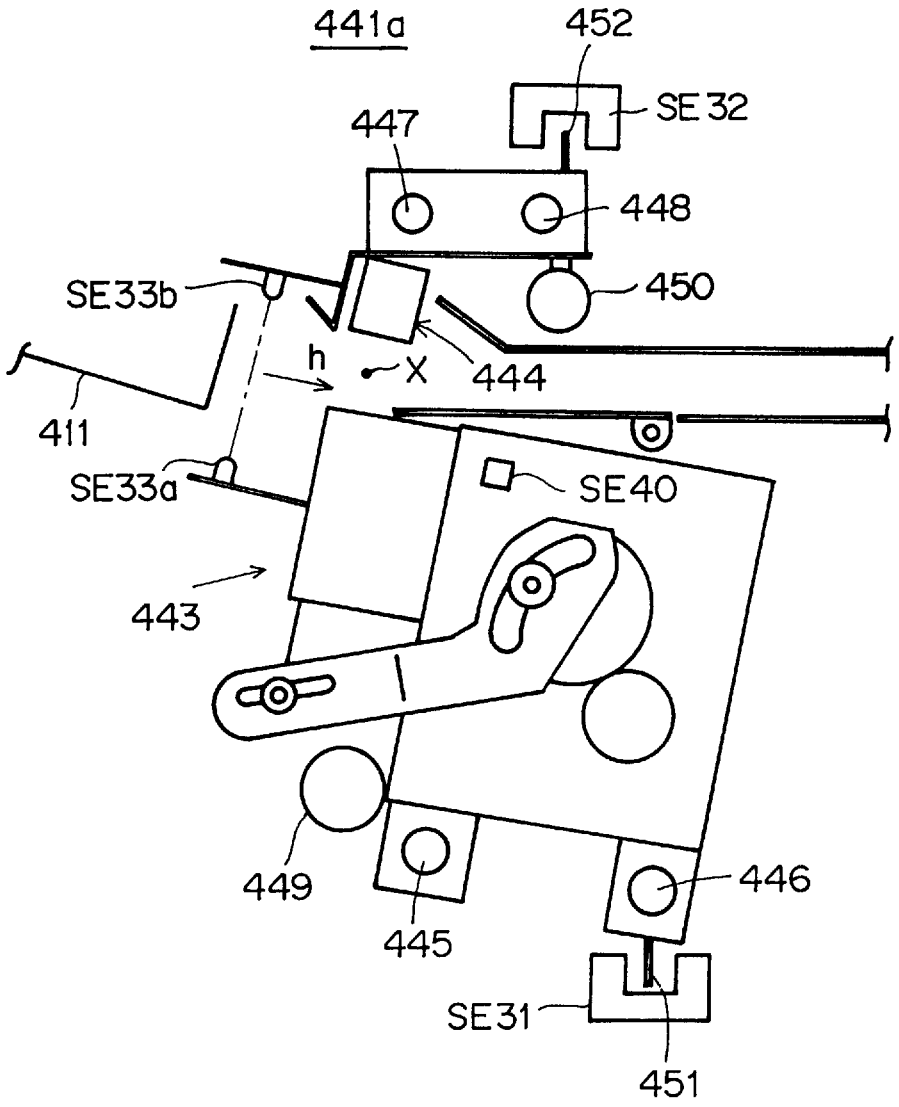
FIG. 22 is a plan view which shows a stapling unit which is the second embodiment.
Figure 23:
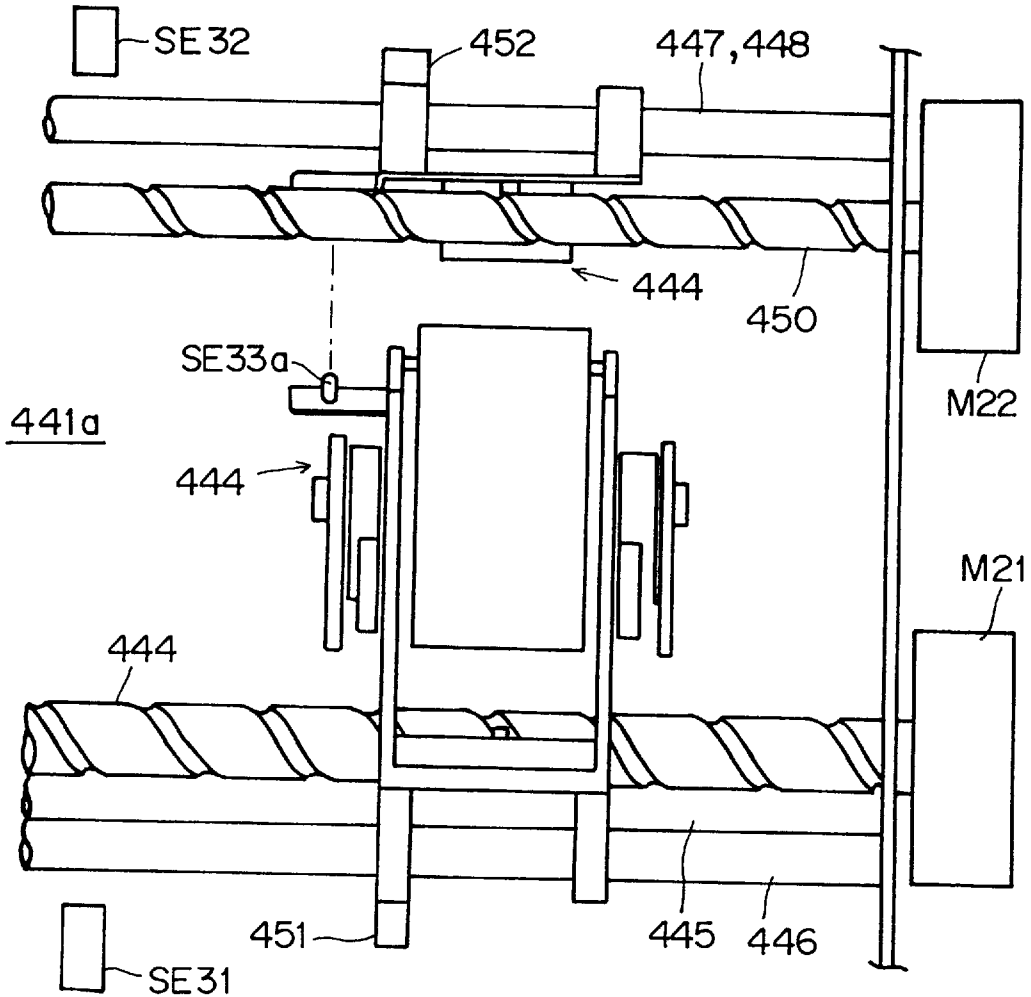
FIG. 23 is a side elevational view which shows the stapling unit which is the second embodiment.

As shown in FIGS. 22 and 23, a stapling unit 441*a* has the same structure as the above-mentioned stapling unit 441 (refer to FIGS. 12, 13 and 14) which is the first embodiment. Thus, the same components are provided with the same reference symbols. In the staple unit 441*a*, the staple head 443 for driving staples and the staple anvil 444 for receiving and bending driven staples are independently movably disposed. The staple head 443 is slidably mounted on the two guide shafts 445 and 446 and is movable in the direction perpendicular to the direction indicated with the arrow h in conjunction with the forward/reverse run of the spiral shaft 449 driven by the stepping motor M21. The staple anvil 444 is slidably mounted on the two guide shafts 447 and 448 and is movable in the direction perpendicular to the direction indicated with the arrow h in conjunction with the forward/reverse run of the spiral shaft 450 driven by the stepping motor M22.

The staple head 443 and the staple anvil 444 have light shield plates 451 and 452 fixed respectively thereto and positions at which the shield plates 451 and 452 are detected by light transmission type sensors SE31 and SE32 are respective home positions of the staple head 443 and the staple anvil 444. The stepping motors M21 and M22 are controllable by the number of driving pulses with respect to their number of revolutions, and the staple head 443 and the staple anvil 444 can be stopped at any desired position independently of each other. The staple head 443 is fitted with a light emitting element SE33*a*, and the staple anvil 444 is fitted with a light receiving element SE33*b*. The elements SE33*a* and SE33*b* mutually detect stopping positions of the staple head 443 and the staple anvil 444, and the control of the elements SE33*a* and SE33*b* is described below.

Next, staple processing of the stapling unit 441*a* is described. This stapling unit 441*a* is a type used only for stapling an trailing portion of a sheet set. Thus, the first chucking device 415 actually transports the sheet set in the third mode.

When the stacking tray 411 receives a sheet set, the sheet set is transported from the tray 411 in the direction indicated with the arrow h by the first chucking device 415, and further transported by the transport rollers 469 and 470 until the trailing portion of the sheet set is set at the stapling position X. At this time, the sheet set is stopped after the trailing portion of the sheet set passes the optical axis of the elements SE33*a* and SE33*b* in the direction indicated with the arrow h. This is not to cut the light axis between the elements SE33*a* and SE33*b*.

For stapling operation, first, the staple head 443 is moved and stopped at a specified stapling point by driving the motor M21. Next, the staple anvil 444 is moved from the home position by driving the motor M22. The drive of the motor M22 is stopped when the light receiving element SE33*b* receives a light from the light emitting element SE33*a*. Thereby, positioning of the staple head 443 and the staple anvil 444 can be done accurately. With the staple head 443 and the staple anvil 444 stopping at a specified stapling point, the staple head 443 begins to drive staples into the sheet set. When there are plural stapling points, first, the staple head 443 moves to a stapling point, and next, the staple anvil 444 moves to a point where the optical axes of the elements SE33*a* and SE33*b* are fitted, and then drives staples.

Also, in the second embodiment of the present invention, the staple anvil 444 can be moved in advance of the staple head 443. Further, it is possible that the light emitting element SE33*a* is provided at the staple anvil 444, and the light receiving element SE33*b* is provided at the staple head 443. Furthermore, as for the driving motor, for a motor which is driven first, it is preferable to use a pulse driving motor, in order to control a moving distance accurately. For a motor which is driven later can be a direct current motor.

(Third embodiment of Stapling Unit)

Figure 24:
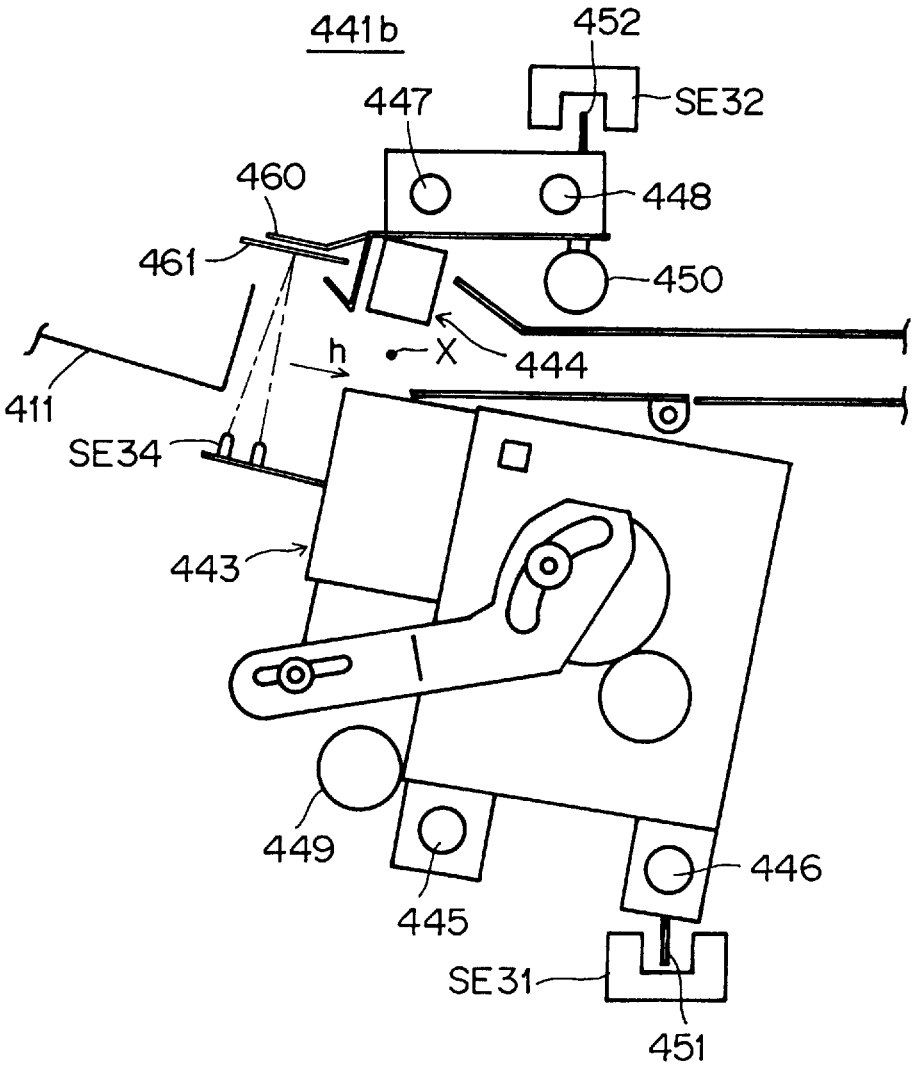
FIG. 24 is a front view which shows a stapling unit which is the third embodiment.
Figure 25:
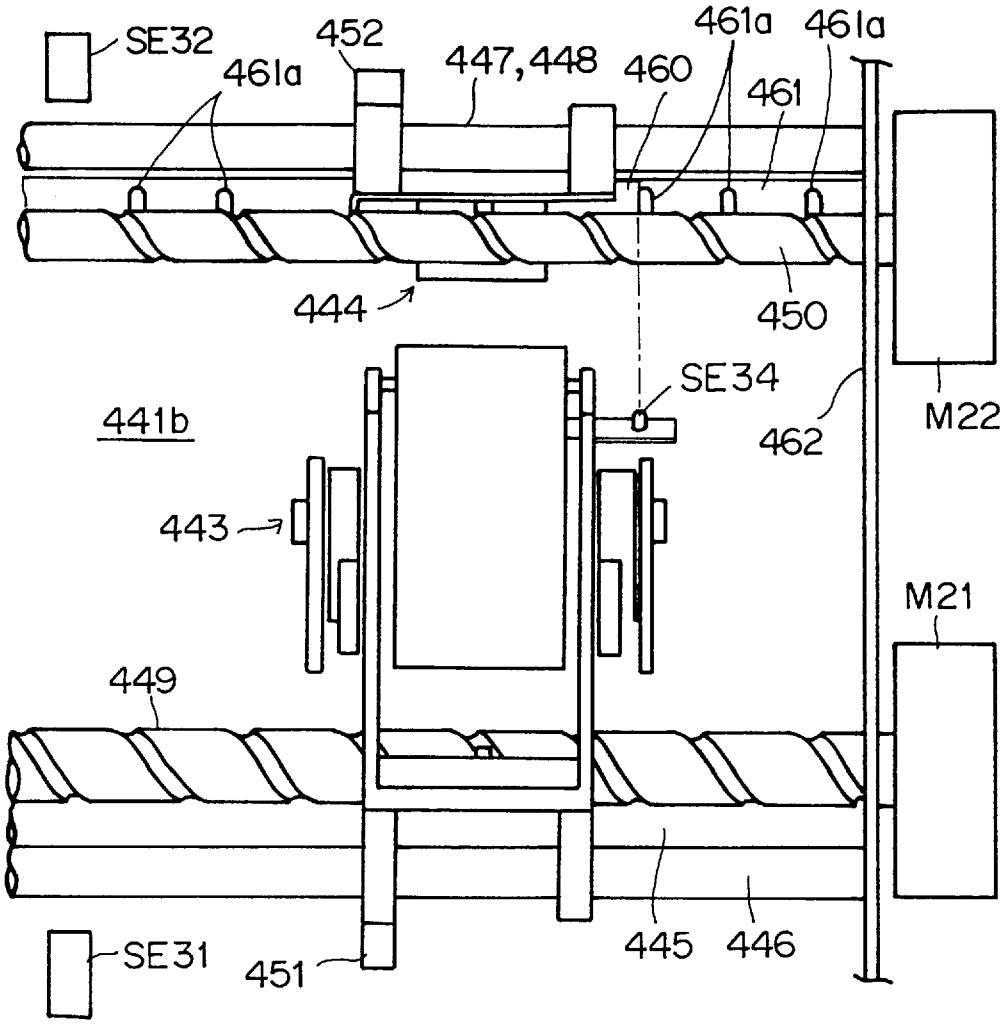
FIG. 25 is a side elevational view which shows the stapling unit which is the third embodiment.

FIGS. 24 and 25 show a stapling unit 441*b* similar in construction to the above described stapling unit 441*a* which is the second embodiment. In order to ensure accurate alignment of the staple head 443 and the staple anvil 444 at a stapling point, the stapling unit 441*b* is provided with a light-reflecting type photosensor SE34. It is to be noted that in FIGS. 24 and 25, parts identical with those in FIGS. 22 and 23 are indicated with the same reference numerals.

The staple head 443 is fitted with the light-reflecting type photosensor SE34, and the staple anvil 444 is fitted with a reflector plate 460. Immediately below the reflector plate 460, there is positioned another reflector plate 461 fixed to a frame 462. The reflector plate 461 is formed with a plurality of openings 461*a* in relation to specified stapling points of respective sheet sizes.

This stapling unit 441*b*, as is the case with the above-described stapling unit 441*a*, is specially designed to carry out stapling a tailing portion of a sheet set. For stapling operation, a sheet set is transported from the stacking tray 411 and stopped when the trailing portion of the sheet set passes the light axis of the photosensor SE34 in the direction indicated with the arrow h. In the stapling operation, the staple head 443 first moves to a predetermined stapling point and stops thereat. In the present instance, when a light emitted from the photosensor SE34 enters the openings 461*a* so that the light is no longer reflected, that is, when the sensor SE34 goes into off condition, movement of the staple head 443 is stopped. The sensor SE34 goes into off condition each time when it passes the openings 461*a*. Therefore, by counting the number of times the sensor SE34 is turned off it is possible to judge whether the staple head 443 is at a specified stapling point or not.

Next, the staple anvil 444 is moved by the motor M22. The reflector plate 460 moves in conjunction with the staple anvil 444. Upon reaching a location above the openings 461*a*, the reflector plate 460 reflects the light from the sensor SE34 through the openings 461*a*. Then, the sensor SE34 turns on to stop movement of the staple anvil 444. Needless to say, the staple head 443 and the staple anvil 444 are so set as to face each other at the moment when the reflector plate 460 causes the sensor SE34 to turn on.

Also, the sensor SE34 may be attached to the staple anvil 444, and the reflector plate 460 is attached to the staple head 443. In this case, the staple anvil 444 is moved in advance of the staple head 443.

(Control Procedure, Second and Third Embodiment)

Figure 26:
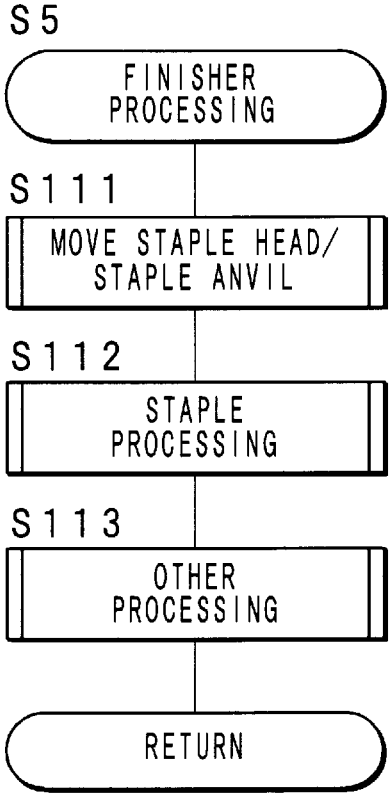
FIG. 26 is a flowchart which shows a subroutine of finisher processing (in accordance with the second and the third embodiments)

FIG. 26 shows a subroutine of finisher processing. The main routine is the same as FIG. 17. In this subroutine, the staple head 443 and the staple anvil 444 are moved to a specified stapling position at step S111, and staples are driven to a sheet set at step S112. Further, other necessary processing such as transportation of sheet sets is carried out at step S113.

Figure 27A:
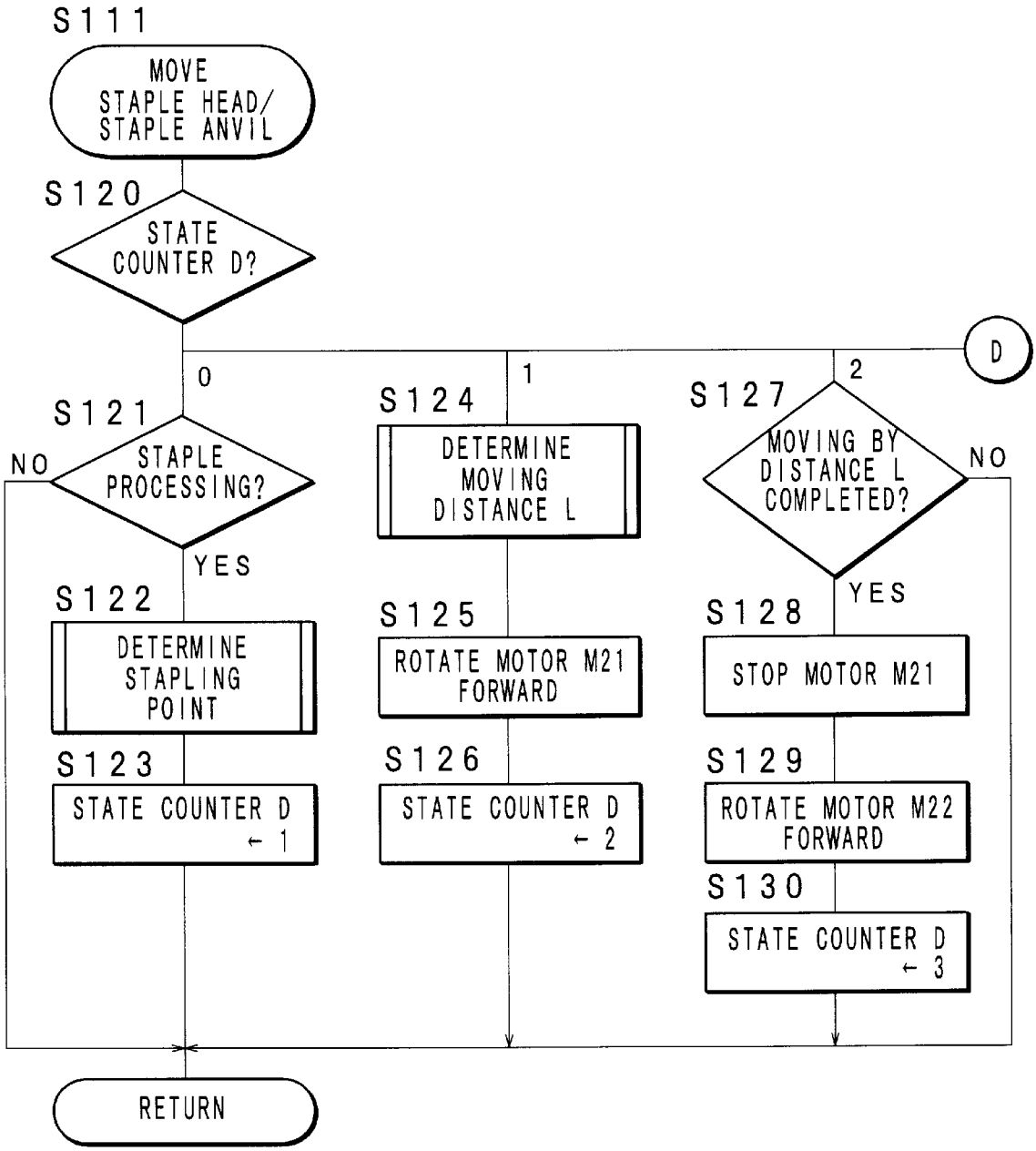
FIGS. 27*a* and 27*b* are flowcharts which show a subroutine of the staple head movement and the staple anvil movement (in accordance with the second embodiment)
Figure 27B:
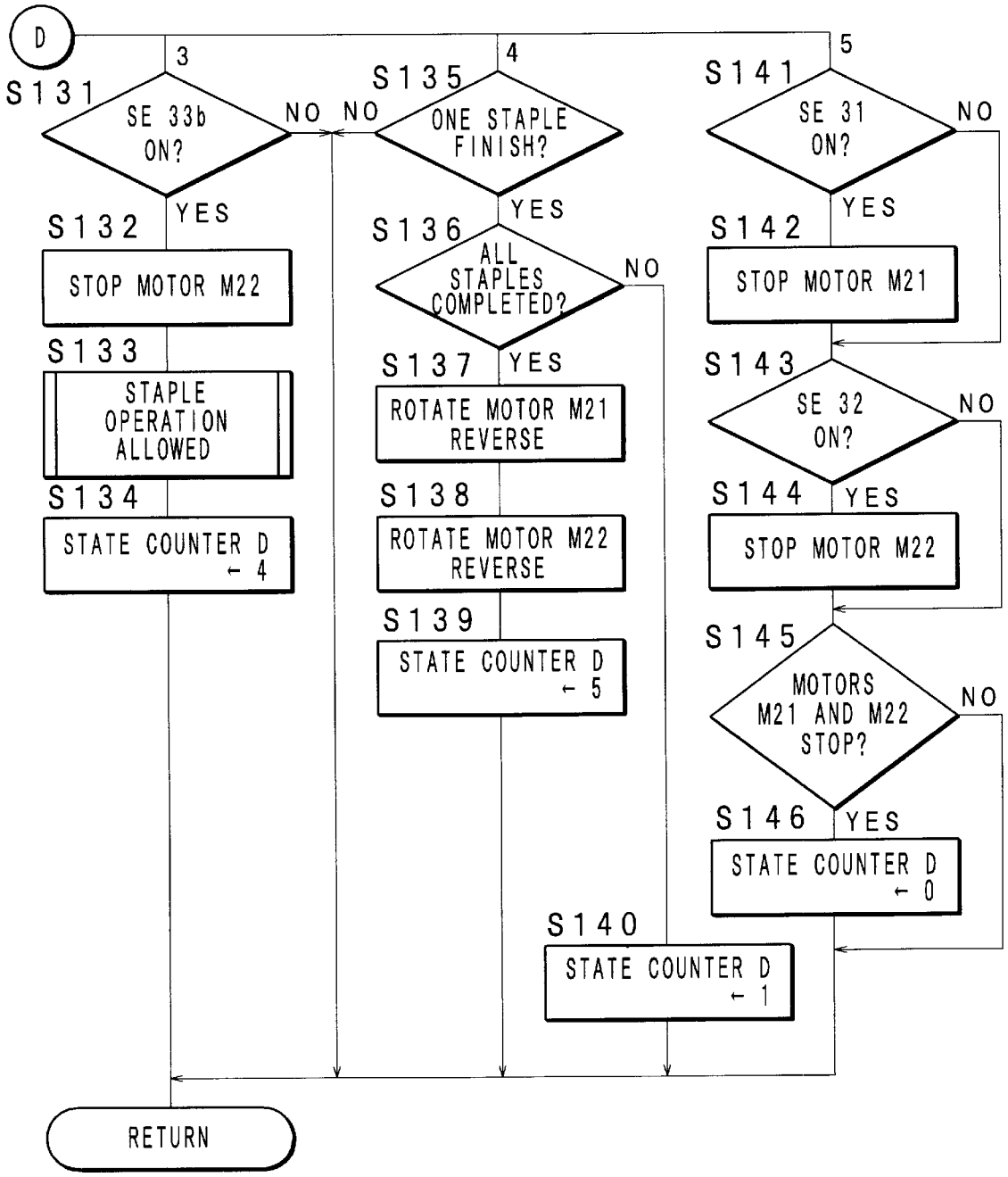

FIGS. 27*a* and 27*b* show a subroutine of moving the staple head/staple anvil of the stapling unit 441*a* which is the second embodiment carried out at step S111. In this subroutine, a count value (an initial value is "0") of the state counter D is checked at step S120, and following processing is carried out according to the count value.

When the state counter D is "0", whether staple processing is to be carried out or not is judged at step S121. If staple processing is to be carried out, a stapling point is determined at step S122. A stapling position is varied according to a sheet size and a staple mode (corner stapling or side stapling). Next, the state counter D is set to "1".

When the staple counter D is "1", a moving distance L of the staple head 443 to a stapling point is determined at step S124. Next, the motor M21 is rotated forward at step S25, and the state counter D is set to "2" at step S126.

When the state counter D is "2", with judging that moving the staple head 443 by the distance L is completed at step S127, the motor M21 is stopped at step S128. Further, the motor M22 is rotated forward at step S129, and the state counter D is set to "3".

When the state counter D is "3", with confirming that the light receiving element SE33*b* is turned on at step S131, that is, when the light receiving element SE33*b* detects a light from the light emitting element SE33*a* and the staple anvil 444 reaches the same position as the staple head 443, the motor M22 is stopped at step S132. Next, the staple operation is allowed at step S133, and the state counter D is set to "4" at step S134.

When the state counter D is "4", whether one staple is finished or not is judged at step S135. If driving one staple is finished, whether driving all necessary staples is completed or not is judged at step S136. When stapling at a plurality of points is to be carried out, the state counter D is set to "1" at step S140, and the steps S124 through S134 are repeated. When all stapling is completed, the motors M21 and M22 are rotated reverse at steps S137 and S138 respectively, and the state counter D is set to "5" at step S139.

When the state counter D is "5", with confirming that the sensor SE31 is turned on at step S141, that is, when the staple head 443 goes back to the home position, the motor M21 is stopped at step S142. Further, with confirming that the sensor SE32 is turned on at step S143, that is, when the staple anvil 444 goes back to the home position, the motor M22 is stopped at step S144. Next, with confirming that both the motors M21 and M22 are stopped at step S145, the state counter D is reset to "0" at step S146.

Figure 28A:
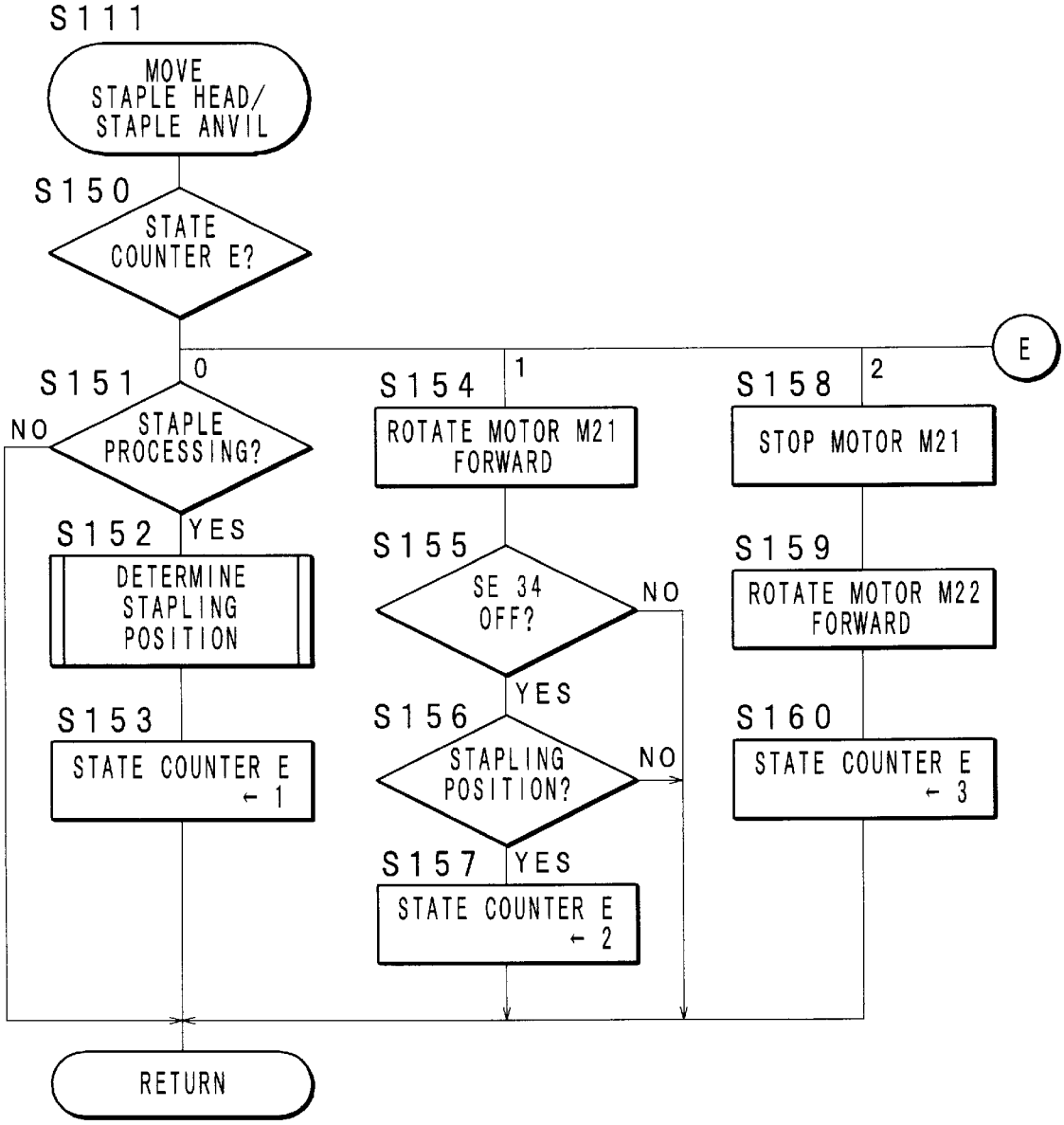
FIGS. 28*a* and 28*b* are flowcharts which show a subroutine of the staple head movement and the staple anvil movement (in accordance with the third embodiment).
Figure 28B:
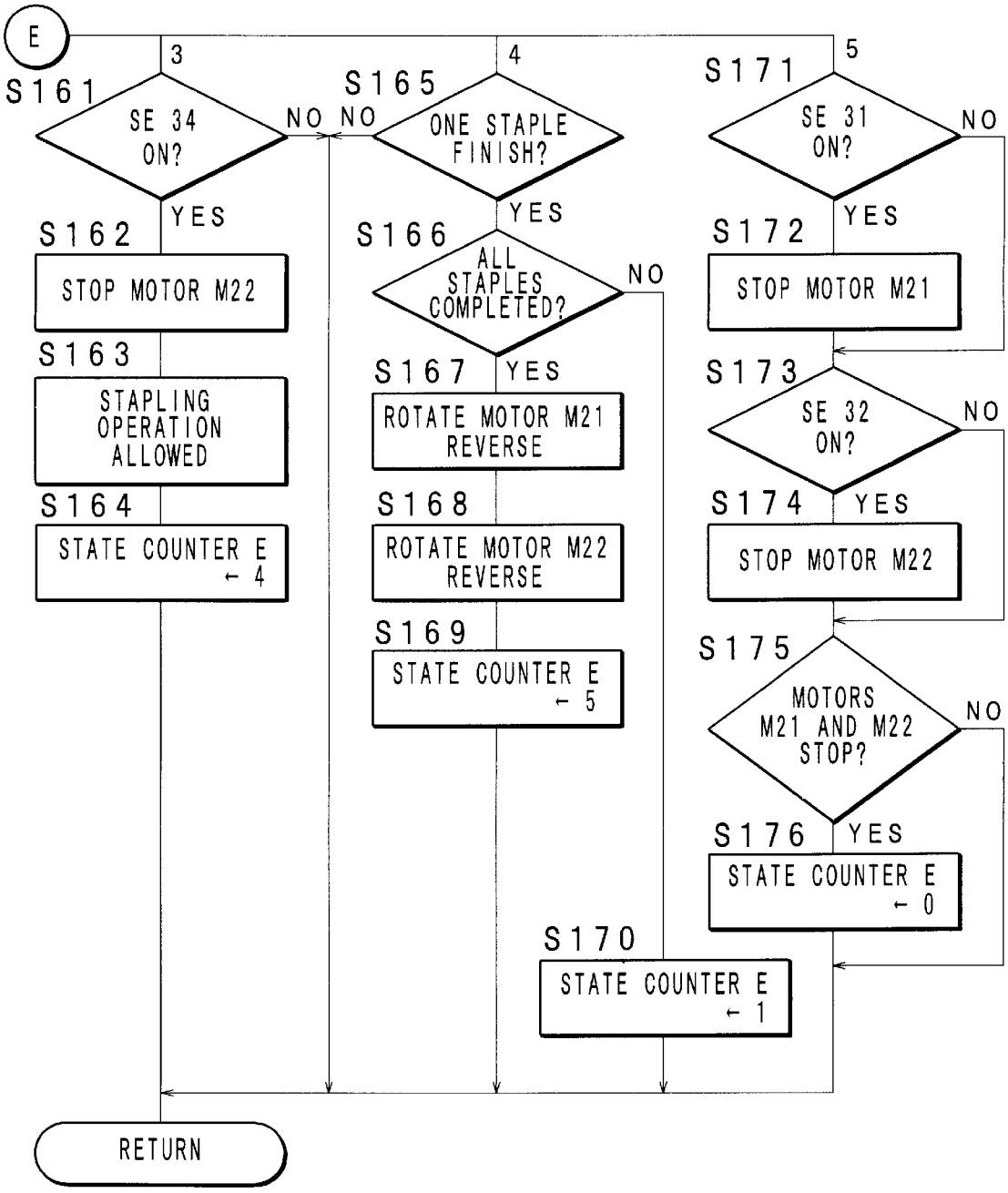

FIGS. 28*a* and 28*b* show a subroutine of moving the staple head/staple anvil of the stapling unit 441*b* which is the third embodiment carried out at step S111. In this subroutine, the count value (an initial value is "0") of the state counter E is checked at step S150, and following processing is carried out according to the counted value.

When the state counter E is "0", whether the staple processing is to be carried out or not is judged at step S151. If the staple processing is to be carried out, a stapling point is determined at step S152. A stapling point is varied according to a sheet size and a staple mode (corner stapling or side stapling), and positions of openings 461*a* which are formed at the reflector plate 461 are equivalent to a stapling point. Next, the state counter E is set to "1" at step S153.

When the state counter E is "1", the motor M21 is rotated forward at step S154, and whether the sensor SE34 is turned off or not is judged at step S155. The sensor SE34 maintains on-status while a light is reflected by the reflector 461, and turns off when the light is incident to an y one of the openings 461*a*. At this time, whether it is a predetermined stapling point or not is judged. If it is a predetermined stapling point, the state counter E is set to "2" at step S157.

When the state counter E is "2", the motor M21 is stopped at step S158. Further, the motor M22 is turned forward at step S159, and the state counter E is set to "3"at step S160.

When the state counter E is "3", with confirming that the sensor SE34 is turned on at step S161, that is, when the reflector plate 460 reaches a position above the opening 461 and reflects a light through the opening 461*a* and the staple anvil 444 reaches the same position as the staple head 443, the motor M22 is stopped at step S162. Next, stapling operation is allowed at step S163, and the state counter E is set to "4".

When the state counter E is "4", whether driving one staple is finished or not is judged at step S165. If driving one staple is finished, whether driving all necessary staples is completed or not is judged at step S166. When stapling at a plurality of points is to be carried out, the state counter E is set to "1" at step S170, and the above-mentioned steps S154 through S164 are repeated. When driving all the staples are completed, the motors M21 and M22 are rotated reverse at steps S167 and S168 respectively, and the state counter E is set to "5" at step S169.

When the state counter E is "5", with confirming that the sensor SE31 is turned on at step S171, that is, when the staple head 443 goes back to the home position, the motor M21 is stopped at step S172.

(Other embodiments)

Although the present invention has been described in connection with the preferred embodiments above, it is to be noted that various changes and modifications are apparent to a person skilled in the art. Such changes and modifications are to be understood as being within the scope of the present invention.

Especially, the structure of the tray 411 and the sheet set transport mechanism are optional.

What is claimed is:

1. A finisher which staples a set of sheets discharged from an image forming apparatus comprising:

sheet stacking means which receives and stacks sheets discharged from the image forming apparatus;

a staple head which drives staples into the stacked set of sheets;

a staple anvil which receives and bends staples driven from the staple head;

first moving means which moves the staple head in a first direction;

second moving means which moves the staple anvil in a second direction;

the first and second directions are substantially parallel to each other; and the first moving means and the second moving means move the staple head and the staple anvil independently.

2. A finisher as claimed in claim 1, further comprising:

detecting means which detects presence and nonpresence of staples contained in the staple head; and control means which, when the staple head is detected empty by the detecting means, drives the first moving means to move the staple head to a staple cartridge exchange position.

3. A finisher as claimed in claim 1, further comprising:

detecting means which detects a jam of staples: and control means which, when a staple jam is detected by the detecting means, drives the second moving means to move the staple anvil to a retreating position.

4. A finisher which staples a set of sheets discharged from an image forming apparatus comprising:

sheet stacking means which receives and stacks sheets discharged from the image forming apparatus;

a staple head which drives staples into the stacked set of sheets;

a staple anvil which receives and bends staples driven from the staple head;

first moving means which moves the staple head;

second moving means which moves the staple anvil; and position detection means which detects mutual positions of the staple head and the staple anvil.

5. A finisher as claimed in claim 4, wherein the position detecting means is composed of a light emitting element which is provided at either the staple head or the staple anvil and a light receiving element which is provided at the other.

6. A finisher as claimed in claim 4, wherein the position detecting means is composed of a light-reflecting type photosensor which is provided at either the staple head or the staple anvil and a reflector plate which is provided at the other.

7. A finisher as claimed in claim 6, further comprising a member which is detected by the light-reflecting type photosensor for recognition of a plurality of stapling points.

8. A finisher which staples a set of sheets discharged from an image forming apparatus comprising:

sheet stacking means which receives and stacks sheets discharged from the image forming apparatus;

a staple head which drives staples into the stacked set of sheets;

a staple anvil which receives and bends staples driven from the staple head;

first moving means which moves the staple head;

second moving means which moves the staple anvil;

position detection means which detects mutual positions of the staple head and the staple anvil; and control means which moves either the staple head or the staple anvil to a specified stapling point, and after that, moves the other to a position detected by the position detecting means.

9. A finisher as claimed in claim 8, wherein the position detecting means is composed of a light emitting element which is provided at either the staple head or the staple anvil and a light receiving element which is provided at the other.

10. A finisher as claimed in claim 8, wherein the position detecting means is composed of a light-reflecting type photosensor which is provided at either the staple head or the staple anvil and a reflector plate which is provided at the other.

11. A finisher as claimed in claim 10, further comprising a member which is detected by the light-reflecting type photosensor for recognition of a plurality of stapling points.

12. A finisher which staples a set of sheets discharged from an image forming apparatus comprising:

sheet stacking device which receives and stacks sheets discharged from the image forming apparatus;

a staple head which drives staples into the stacked set of sheets;

a staple anvil which receives and bends staples driven from the staple head;

a first guide shaft which supports the staple head; and a second guide shaft which supports the staple anvil.

13. A finisher as claimed in claim 12, further comprising:

a first motor which moves the staple head; and a second motor which moves the staple anvil.

14. A finisher as claimed in claim 13, further comprising:

a sensor which detects presence and non-presence of staples contained in the staple head; and a controller which, when the staple head is detected empty by the sensor, drives the first motor to move the staple head to a staple cartridge exchange position.

15. A finisher as claimed in claim 13, further comprising:

a sensor which detects a jam of staples; and controller which, when a staple jam is detected by the sensor, drives the second motor to move the staple anvil to a retreating position.

16. A finisher as claimed in claim 12, further comprising a position detector which detects mutual positions of the staple head and the staple anvil.

17. A finisher as claimed in claim 16, wherein the position detector is composed of a light emitting element which is provided at either the staple head or the staple anvil and a light receiving element which is provided at the other.

18. A finisher as claimed in claim 16, wherein the position detector is composed of a light-reflecting type photosensor which is provided at either the staple head or the staple anvil and a reflector plate which is provided at the other.

19. A finisher as claimed in claim 18, further comprising a member which is detected by the light-reflecting type photosensor for recognition of a plurality of stapling points.

20. A finisher as claimed in claim 12, further comprising:

a position detector which detects mutual positions of the staple head and the staple anvil; and a controller which moves either the staple head or the staple anvil to a specified stapling point, and after that, moves the other to a position detected by the position detector.

21. A finisher as claimed in claim 20, wherein the position detector is composed of a light emitting element which is provided at either the staple head or the staple anvil and a light receiving element which is provided at the other.

22. A finisher as claimed in claim 20, wherein the position detector is composed of a light-reflecting type photosensor which is provided at either the staple head or the staple anvil and a reflector plate which is provided at the other.

23. A finisher as claimed in claim 22, further comprising a member which is detected by the light-reflecting type photosensor for recognition of a plurality of stapling points.

24. A method of stapling a set of sheets discharged from an image forming apparatus, the method comprising the steps of:

receiving and stacking sheets discharged from the image forming apparatus;

transporting the stacked set of sheets in a length direction thereof;

moving a staple head and a staple anvil in a width direction of the set of sheets independently of each other;

driving a staple from the staple head into the set of sheets and bending the staple on the staple anvil; and transporting the stapled set of sheets in the length direction thereof without moving the staple head and the staple anvil.

* * * * *